US007758044B2

(12) United States Patent
Nonaka

(10) Patent No.: US 7,758,044 B2
(45) Date of Patent: Jul. 20, 2010

(54) IMAGE FORMING APPARATUS, SHEET CONVEYING DEVICE, AND SHEET CONVEYING METHOD

(75) Inventor: Manabu Nonaka, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 318 days.

(21) Appl. No.: 11/827,081

(22) Filed: Jul. 9, 2007

(65) Prior Publication Data

US 2008/0006995 A1 Jan. 10, 2008

(30) Foreign Application Priority Data

Jul. 10, 2006 (JP) ..... 2006-189144

(51) Int. Cl.
*B65H 5/02* (2006.01)
*B65H 5/04* (2006.01)

(52) U.S. Cl. ..... 271/274; 271/272; 271/273

(58) Field of Classification Search ..... 271/272, 271/273, 274
See application file for complete search history.

(56) References Cited

U.S. PATENT DOCUMENTS

| | | | | |
|---|---|---|---|---|
| 3,863,913 | A * | 2/1975 | Hirafuji | 271/265.02 |
| 4,353,274 | A * | 10/1982 | Shimizu | 83/156 |
| 6,338,483 | B1 * | 1/2002 | Andela et al. | 271/227 |
| 7,427,065 | B2 * | 9/2008 | Maruyama | 271/273 |
| 7,438,288 | B2 * | 10/2008 | Nishiberi et al. | 271/256 |
| 7,523,933 | B2 * | 4/2009 | Linder et al. | 271/274 |
| 7,568,696 | B2 * | 8/2009 | Henson | 271/270 |
| 7,593,683 | B2 * | 9/2009 | Kim et al. | 399/388 |
| 2004/0251618 | A1 * | 12/2004 | Niizeki | 271/272 |
| 2005/0184455 | A1 * | 8/2005 | Youn | 271/274 |
| 2005/0194730 | A1 | 9/2005 | Nishida et al. | |
| 2006/0050104 | A1 | 3/2006 | Sakakitani | |
| 2006/0181569 | A1 | 8/2006 | Kawashima et al. | |
| 2007/0102873 | A1 * | 5/2007 | Acton et al. | 271/273 |

FOREIGN PATENT DOCUMENTS

| | | |
|---|---|---|
| JP | 2000-177874 | 6/2000 |
| JP | 2001-282041 | 10/2001 |
| JP | 2002-55550 | 2/2002 |
| JP | 2005-173121 | 6/2005 |

* cited by examiner

*Primary Examiner*—Patrick Mackey
*Assistant Examiner*—Prasad V Gokhale
(74) *Attorney, Agent, or Firm*—Cooper & Dunham LLP

(57) ABSTRACT

A sheet conveying device is described for conveying, for example, a sheet bearing an image in an image forming apparatus. The sheet conveying device includes an upstream conveying roller pair, a downstream conveying roller pair, a sheet condition detector, and a pressure adjuster. The sheet condition detector detects a convey condition of the sheet when the sheet is nipped and conveyed by the upstream conveying roller pair and the downstream conveying roller pair. The pressure adjuster adjusts a pressure applied by at least one of the upstream conveying roller pair and the downstream conveying roller pair to the sheet based on a detection result provided by the sheet condition detector.

15 Claims, 13 Drawing Sheets

IMAGE FORMING APPARATUS, SHEET CONVEYING DEVICE, AND SHEET CONVEYING METHOD

TECHNICAL FIELD

The present specification describes an image forming apparatus, a sheet conveying device, and a sheet conveying method, and more particularly an image forming apparatus, a sheet conveying device, and a sheet conveying method for conveying a sheet.

DISCUSSION OF THE BACKGROUND

An image forming apparatus, such as a copying machine, a printer, a facsimile machine, a plotter, or a multifunction printer having copying, printing, scanning, and facsimile functions, can form an image on a recording medium (e.g., a sheet) by a liquid discharging method. For example, a recording head (e.g., a liquid discharging head) discharges a recording liquid (e.g. an ink drop) onto a conveyed sheet to form an image on the sheet. Alternatively, an image forming apparatus can form an image on a sheet by an electrophotographic method. A conveying roller pair feeds the sheet bearing the image to an output tray so that a user can pick up the sheet.

In an image forming apparatus using the liquid discharging method, a sheet bearing an image may slip on a conveying roller pair while the sheet is nipped and conveyed by the conveying roller pair. When an ink drop forming the image on the sheet is not dried, the conveying roller pair may scrape the image on the sheet and may stain the sheet, resulting in formation of a faulty image. The ink drop may be transferred from the sheet onto the conveying roller pair and may stain the conveying roller pair, decreasing a conveying performance of the conveying roller pair. The ink drop transferred to the conveying roller pair may be transferred back to a sheet.

To prevent a sheet from slipping on the conveying roller pair, an exemplary image forming apparatus includes an upstream conveying roller pair and a downstream conveying roller pair. The upstream conveying roller pair is disposed upstream from the downstream conveying roller pair in a sheet conveyance direction. The downstream conveying roller pair rotates at a speed smaller than a speed at which the upstream conveying roller pair rotates, so that a sheet is slacked between the upstream conveying roller pair and the downstream conveying roller pair.

To slack the sheet, guides, opposing each other to form a conveying path provided between the upstream conveying roller pair and the downstream conveying roller pair, face each other with a substantial distance therebetween. Namely, a large space is needed in the conveying path to slack the sheet between the upstream conveying roller pair and the downstream conveying roller pair. As a result, the image forming apparatus has a large size and the guides may not easily guide a foremost head of a sheet to a nip formed by each of the upstream conveying roller pair and the downstream conveying roller pair.

Even when the downstream conveying roller pair rotates at a lower speed than the upstream conveying roller pair, the downstream conveying roller pair may draw a sheet at a relatively higher speed due to change in the rotating speed of the downstream conveying roller pair. Accordingly, the slack of the sheet is decreased and thereby the sheet may easily slip on the downstream conveying roller pair.

SUMMARY

This patent specification describes a novel image forming apparatus. One example of a novel image forming apparatus includes an image forming device configured to form an image on a sheet and a sheet conveying device configured to convey the sheet bearing the image. The sheet conveying device includes an upstream conveying roller pair, a downstream conveying roller pair, a sheet condition detector, and a pressure adjuster. The upstream conveying roller pair is configured to convey a sheet. The downstream conveying roller pair is disposed downstream from the upstream conveying roller pair in a sheet conveyance direction, and is configured to convey the sheet. The sheet condition detector is configured to detect a convey condition of the sheet when the sheet is nipped and conveyed by the upstream conveying roller pair and the downstream conveying roller pair. The pressure adjuster is configured to adjust a pressure applied by at least one of the upstream conveying roller pair and the downstream conveying roller pair to the sheet based on a detection result provided by the sheet condition detector.

This patent specification further describes a novel sheet conveying device. One example of a novel sheet conveying device includes an upstream conveying roller pair, a downstream conveying roller pair, a sheet condition detector, and a pressure adjuster. The upstream conveying roller pair is configured to convey a sheet. The downstream conveying roller pair is disposed downstream from the upstream conveying roller pair in a sheet conveyance direction, and is configured to convey the sheet. The sheet condition detector is configured to detect a convey condition of the sheet when the sheet is nipped and conveyed by the upstream conveying roller pair and the downstream conveying roller pair. The pressure adjuster is configured to adjust a pressure applied by at least one of the upstream conveying roller pair and the downstream conveying roller pair to the sheet based on a detection result provided by the sheet condition detector.

This patent specification further describes a novel sheet conveying method. One example of a novel sheet conveying method includes forming an image on a sheet, and nipping and conveying the sheet bearing the image with an upstream conveying roller pair and a downstream conveying roller pair. The method further includes detecting a convey condition of the sheet when the sheet is nipped and conveyed by the upstream conveying roller pair and the downstream conveying roller pair. The method further includes adjusting a pressure applied by at least one of the upstream conveying roller pair and the downstream conveying roller pair to the sheet based on a detection result.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF THE EXEMPLARY EMBODIMENTS

Figure 1:
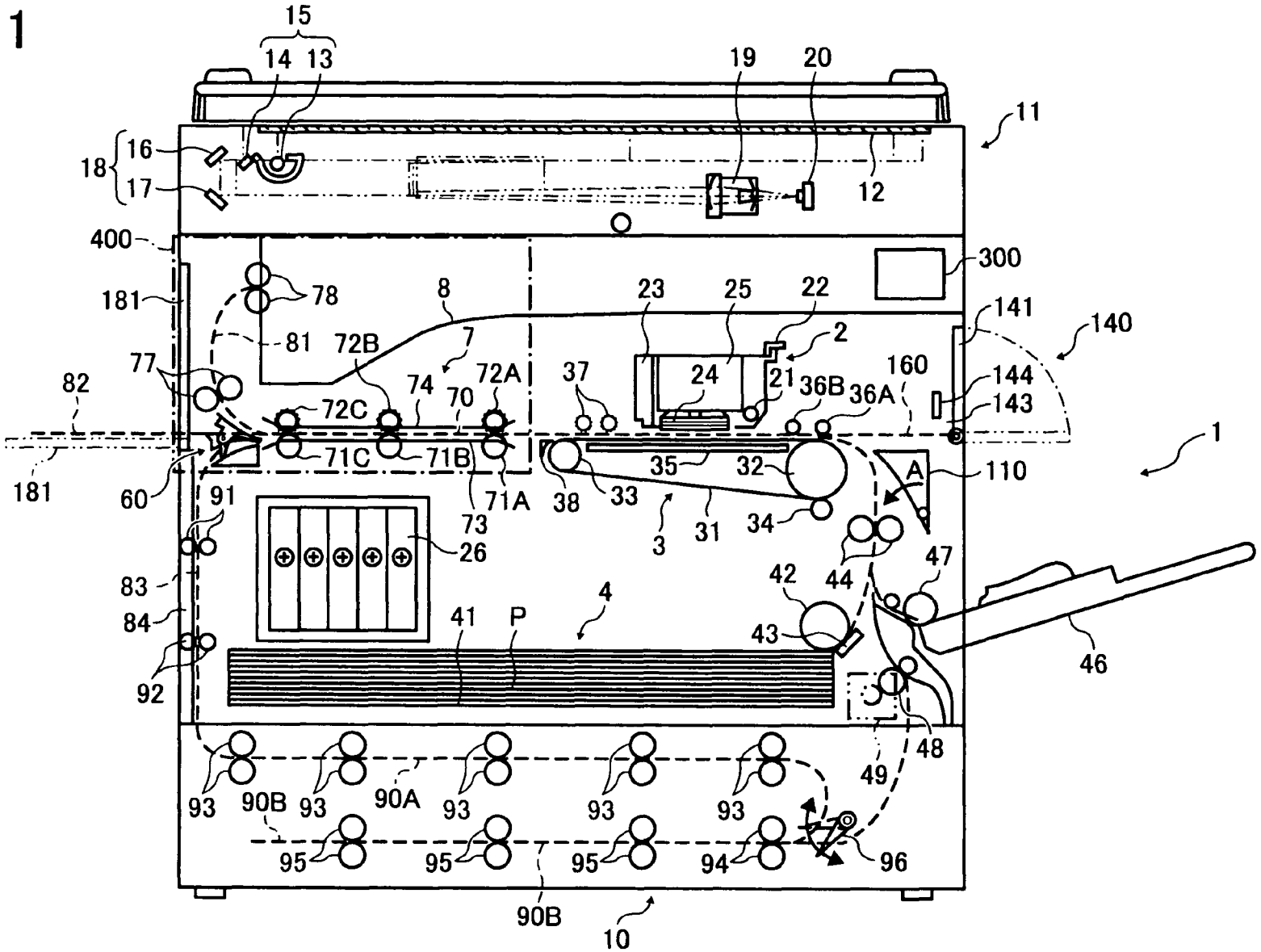
FIG. 1 is a schematic view of an image forming apparatus according to an exemplary embodiment.

In describing exemplary embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, in particular to FIG. 1, an image forming apparatus 1 according to an exemplary embodiment is explained.

FIG. 1 is a schematic view of the image forming apparatus 1. As illustrated in FIG. 1, the image forming apparatus 1 includes a reader 11, a paper tray unit 4, a sub-scanning direction conveyer 3, an image forming device 2, an output device 400, a duplex unit 10, a guide 110, a bypass sheet supplier 140, a bypass-convey path 160, ink cartridges 26, and a controller 300. The reader 11 includes an exposure glass 12, optical scanning systems 15 and 18, a lens 19, and a scanning element 20. The optical scanning system 15 includes a light source 13 and a mirror 14. The optical scanning system 18 includes mirrors 16 and 17. The image forming device 2 includes a guide rod 21, a guide stay 22, a carriage 23, recording heads 24, and sub tanks 25. The paper tray unit 4 includes a paper tray 41, a feeding roller 42, a friction pad 43, a registration roller pair 44, a bypass tray 46, a bypass tray roller 47, a conveying roller 48, and a feeding motor 49. The sub-scanning direction conveyer 3 includes a conveying belt 31, a conveying roller 32, a tension roller 33, a charging roller 34, a guide 35, two pressing rollers 36A and 36B, two spur rollers 37, and a separating nail 38. The output device 400 includes an output conveyer 7 and an output tray 8. The output conveyer 7 includes three conveying rollers 71A, 71B, and 71C, three spur rollers 72A, 72B, and 72C, a lower guide 73, an upper guide 74, a conveying path 70, a first output path 81, a downstream conveying roller pair 77, an output roller pair 78, a second output path 82, a straight output tray 181, and a switching mechanism 60. The duplex unit 10 includes a vertical path 83, a horizontal path 90A, a switchback path 90B, and a switching board 96. The vertical path 83 includes a guide plate 84, an entrance roller pair 91, and an exit roller pair 92. The horizontal path 90A includes five conveying roller pairs 93. The switchback path 90B includes an exit roller pair 94 and three conveying roller pairs 95. The bypass sheet supplier 140 includes a bypass tray 141, an opening 143, and a shutter 144.

The image forming apparatus 1 can be included in any of a copying machine, a printer, a facsimile machine, and a multifunction printer including copying, printing, scanning, and facsimile functions. In this non-limiting exemplary embodiment, the image forming apparatus 1 functions as a multifunction printer for forming a color image on a recording medium.

The reader 11 (e.g., a scanner) is disposed in an upper portion of the image forming apparatus 1 and above the output device 400, and scans an image on an original to generate image data (e.g., print data). The paper tray unit 4 is disposed in a lower portion of the image forming apparatus 1. The paper tray unit 4 loads a recording medium (e.g., a plurality of sheets P), which is not limited to paper, and feeds sheets P one by one towards the sub-scanning direction conveyer 3. The sub-scanning direction conveyer 3 opposes the image forming device 2 and serves as a print-convey path for conveying a sheet P fed from the paper tray unit 4 so that the sheet P opposes the image forming device 2. For example, the sub-scanning direction conveyer 3 turns a direction in which a sheet P fed from the paper tray unit 4 is conveyed by about 90 degrees so that the sheet P opposes the image forming device 2, and conveys the sheet P towards the output device 400. The image forming device 2 discharges a liquid drop onto the sheet P conveyed by the sub-scanning direction conveyer 3 according to the image data generated by the reader 11, so as to form an image on the sheet P. In the output device 400, when a print request requests a one-sided printing, the output conveyer 7 conveys and outputs the sheet P onto the output tray 8 disposed in the upper portion of the image forming apparatus 1. When a print request requests a two-sided printing, the output conveyer 7 conveys the sheet P towards the duplex unit 10 disposed in a bottom portion of the image forming apparatus 1. The duplex unit 10 reverses the sheet P fed from the output conveyer 7, and feeds the sheet P towards the image forming device 2, so that an image is formed on the other side of the sheet P. The guide 110 is disposed between the paper tray unit 4 and the sub-scanning direction conveyer 3, and swings to slack the sheet P fed from the paper tray unit 4. When an image is formed on the other side of the sheet P, the sub-scanning direction conveyer 3 conveys the sheet P towards the output tray 8 via the output conveyer 7. The bypass sheet supplier 140 loads a sheet P such as thick paper and an OHP (overhead projector) transparency. The bypass-convey path 160 conveys the sheet P sent from the bypass sheet supplier 140 towards the sub-scanning direction conveyer 3 and the image forming device 2. The ink cartridges 26 are attachable to and detachable from a front of the image forming apparatus 1, and contain black, cyan, magenta, and yellow inks, respectively. The controller 300 controls operations of the image forming apparatus 1.

In the reader 11, an original having an image thereon is placed on the exposure glass 12 facing down. The optical scanning systems 15 and 18 move to scan the image on the original. The light source 13 irradiates light onto the original placed on the exposure glass 12. The mirror 14 deflects the light reflected by the original towards the mirror 16. The mirror 16 further deflects the light deflected by the mirror 14 towards the mirror 17. The mirror 17 further deflects the light deflected by the mirror 16 towards the lens 19. The lens 19 irradiates the light deflected by the mirror 17 towards the scanning element 20. The scanning element 20 converts the light into an image signal. The image signal is digitized and processed to generate image data.

The image forming apparatus 1 may also receive print data (e.g., image data) sent from a host device, such as an information processing device (e.g., a personal computer), an image scanning device (e.g., an image scanner), and a shooting device (e.g., a digital camera), via a cable or a network. The image forming device 2 may form an image according to the print data sent by the host device.

In the image forming device 2, the guide rod 21 and the guide stay 22 support the carriage 23 in a state that the carriage 23 is movable in a main scanning direction. The carriage 23 carries the recording heads 24. The recording heads 24 discharge liquid drops onto a sheet P sent from the paper tray unit 4 according to the image data generated by the reader 11. The sub tanks 25 are mounted on the carriage 23 and contain ink to be supplied to the recording heads 24.

The black, cyan, magenta, and yellow inks contained in the ink cartridges 26 are supplied to the sub tanks 25, respectively. The black ink is supplied from one ink cartridge 26 to two sub tanks 25.

In the paper tray unit 4, the paper tray 41 loads a plurality of sheets P, and is attachable to and detachable from the front of the image forming apparatus 1. The feeding roller 42 and the friction pad 43 feed the sheets P from the paper tray 41 one by one towards the registration roller pair 44. The registration roller pair 44 feeds the sheet P fed by the feeding roller 42 towards the sub-scanning direction conveyer 3 at a proper time. The bypass tray 46 loads sheets P. The bypass tray roller 47 feeds the sheets P from the bypass tray 46 one by one towards the registration roller pair 44. The conveying roller 48 feeds a sheet P fed from another paper tray (not shown), which may be optionally attached to the lower portion of the image forming apparatus 1, or the duplex unit 10 towards the registration roller pair 44. The feeding motor 49 includes a HB (hybrid) type stepping motor and serves as a driver for rotatably driving members for feeding the sheet P towards the sub-scanning direction conveyer 3, such as the feeding roller 42, the registration roller pair 44, the bypass tray roller 47, and the conveying roller 48, via an electromagnetic clutch (not shown). The registration roller pair 44 temporarily stops the sheet P fed by the feeding roller 42, the bypass tray roller 47, or the conveying roller 48.

In the sub-scanning direction conveyer 3, the conveying belt 31 is formed in an endless belt-like shape and is looped over the conveying roller 32 and the tension roller 33. The conveying roller 32 serves as a driving roller for rotatably driving the conveying belt 31. The tension roller 33 serves as a driven roller for being rotatably driven by the rotating conveying belt 31 driven by the conveying roller 32, and applies tension to the conveying belt 31. The charging roller 34 serves as a charger for receiving a high, alternating voltage applied by a high voltage power source (not shown) to charge a surface of the conveying belt 31. The guide 35 opposes the image forming device 2 and guides the rotating conveying belt 31. The two pressing rollers 36A and 36B oppose the conveying roller 32 via the conveying belt 31 and press the sheet P conveyed on the conveying belt 31 towards the conveying belt 31. The pressing roller 36A is disposed upstream from the pressing roller 36B in a sheet conveyance direction. The two spur rollers 37 press the sheet P bearing an image formed by the image forming device 2 and conveyed on the conveying belt 31 towards the conveying belt 31. The separating nail 38 separates the sheet P bearing the image from the conveying belt 31.

In the output conveyer 7, the three conveying rollers 71A, 71B, and 71C feed the sheet P separated from the conveying belt 31 by the separating nail 38 towards the switching mechanism 60. The spur rollers 72A, 72B, and 72C oppose the conveying rollers 71A, 71B, and 71C, respectively, and feed the sheet P towards the switching mechanism 60 together with the conveying rollers 71A, 71B, and 71C. The lower guide 73 and the upper guide 74 guide the sheet P fed by the conveying rollers 71A, 71B, and 71C and the spur rollers 72A, 72B, and 72C. The conveying path 70, serving as a horizontal convey path, is provided between the lower guide 73 and the upper guide 74, and conveys the sheet P sent from the sub-scanning direction conveyer 3 towards the first output path 81. The first output path 81, serving as a reverse-convey path, reverses and conveys the sheet P sent from the conveying path 70 towards the output tray 8 so that the sheet P is output onto the output tray 8 facing down. The downstream conveying roller pair 77 and the output roller pair 78 are provided in the first output path 81 and feed the sheet P towards the output tray 8. The conveying path 70 has a length providing a time period in which ink forming the image on the sheet P is dried to an extent that the image is not smeared when the sheet P is reversed and output onto the output tray 8.

The second output path 82 conveys the sheet P onto the straight output tray 181. The straight output tray 181 receives the sheet P fed by the conveying roller 71C and the spur roller 72C. The switching mechanism 60 is provided at an exit from the conveying path 70, and moves to guide the sheet P towards the first output path 81, the second output path 82, or the duplex unit 10.

In the duplex unit 10, the vertical path 83 is provided in one side portion of the image forming apparatus 1, and conveys the sheet P guided by the switching mechanism 60 downward towards the horizontal path 90A. The horizontal path 90A conveys the sheet P sent from the vertical path 83 in a horizontal direction towards the switchback path 90B. The switchback path 90B switches back the sheet P and conveys the sheet P towards the conveying roller 48. The switching board 96 swings to switch between a position illustrated in a solid line and a position illustrated in a broken line. When the switching board 96 is positioned at the position illustrated in the solid line, the sheet P is fed from the horizontal path 90A towards the switchback path 90B. When the switching board 96 is positioned at the position illustrated in the broken line, the sheet P is fed from the switchback path 90B towards the conveying roller 48.

The guide plate 84 is provided in the side portion of the image forming apparatus 1 and forms the vertical path 83. The entrance roller pair 91 feeds the sheet P guided by the switching mechanism 60 downward towards the exit roller pair 92. The exit roller pair 92 further feeds the sheet P towards the conveying roller pairs 93. The conveying roller pairs 93 feed the sheet P towards the exit roller pair 94. The exit roller pair 94 feeds the sheet P towards the conveying roller pairs 95. The exit roller pair 94 and the conveying roller pairs 95 also function as reverse rollers. For example, the conveying roller pairs 95 feed the sheet P towards the exit roller pair 94. The exit roller pair 94 feeds the sheet P towards the conveying roller 48. The conveying roller 48 feeds the sheet P towards the registration roller pair 44.

The sheet P fed from the paper tray 41, the bypass tray 46, or the duplex unit 10 is further fed by the registration roller pair 44 towards the sub-scanning direction conveyer 3. While the sheet P is nipped by the conveying roller 32 and the pressing roller 36A via the conveying belt 31 and by the registration roller pair 44, the guide 110 swings in a direction A to slack the sheet P so as to prevent the sheet P from being tensioned backward.

When the registration roller pair 44 feeds the sheet P towards the sub-scanning direction conveyer 3, the guide 110 swings in the direction A to slack and guide the sheet P towards the sub-scanning direction conveyer 3. When the sheet P reaches the sub-scanning direction conveyer 3, the guide 110 swings back to the initial position to become ready for slacking a next sheet P.

In the bypass sheet supplier 140, the bypass tray 141 is disposed in one side of the image forming apparatus 1 and is openable from and closable to the image forming apparatus 1. To insert a sheet P into the bypass tray 141, the bypass tray 141 is opened to an open position illustrated in a chain double-dashed line. The opening 143 is disposed downstream from the bypass tray 141 in the sheet conveyance direction and is opened and closed by the shutter 144. The shutter 144 is disposed upstream from the sub-scanning direction conveyer 3 in the sheet conveyance direction. The shutter 144 closes to regulate the sheet P inserted into the bypass tray 141 in a sub-scanning direction and opens to send the sheet P to the bypass-convey path 160 through the opening 143. A top surface of the guide 110 guides the sheet P fed from the bypass tray 141 straight towards a nip formed between the pressing roller 36A and the conveying roller 32 via the conveying belt 31.

The straight output tray 181 is disposed in another side of the image forming apparatus 1 and is openable from and closable to the image forming apparatus 1. When the straight output tray 181 is opened, the second output path 82 is formed to convey a sheet P bearing an image and guided by the lower guide 73 and the upper guide 74 straight onto the straight output tray 181. Thus, the sheet P is output onto the straight output tray 181 facing up.

When the bypass tray 141 and the straight output tray 181 are used, a sheet (e.g., an OHP transparency and thick paper) which may not be easily bent, is conveyed straight from the bypass tray 141 to the straight output tray 181. Plain paper may also be conveyed straight from the bypass tray 141 to the straight output tray 181.

Figure 2:
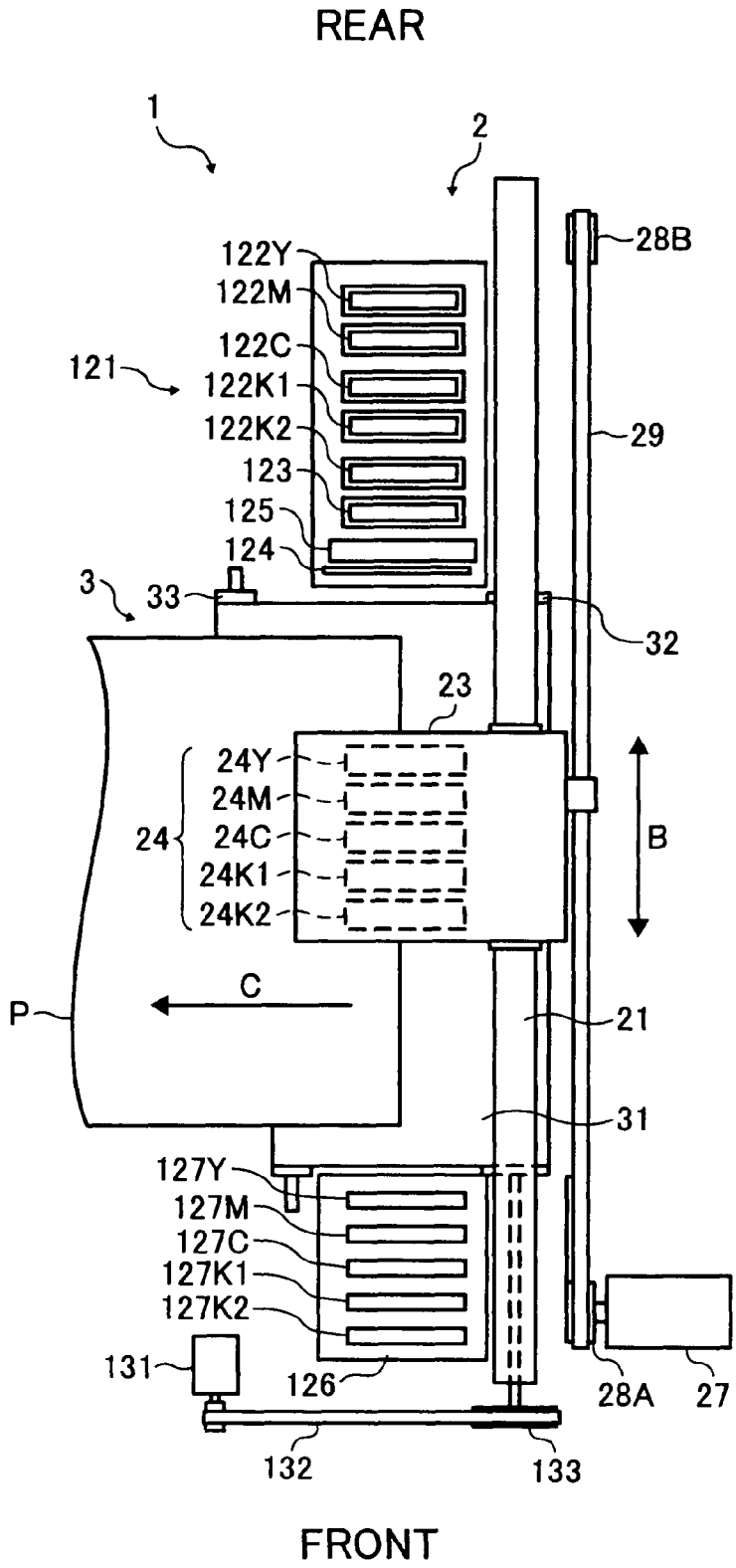
FIG. 2 is a top view of an image forming device and a sub-scanning direction conveyer of the image forming apparatus shown in FIG. 1.

FIG. 2 is a top view of the image forming device 2 and the sub-scanning direction conveyer 3. As illustrated in FIG. 2, the image forming device 2 further includes a timing belt 29, a driving pulley 28A, a driven pulley 28B, a main scanning motor 27, a maintenance-recovery mechanism 121, and an idle discharge receiver 126. The sub-scanning direction conveyer 3 further includes a sub-scanning motor 131, a timing belt 132, and a timing roller 133. The recording heads 24 include five liquid drop discharging heads 24K2, 24K1, 24C, 24M, and 24Y. The maintenance-recovery mechanism 121 includes five moisture retention caps 122K2, 122K1, 122C, 122M, and 122Y, a sucking cap 123, a wiper blade 124, and an idle discharge receiver 125. The idle discharge receiver 126 includes five openings 127K2, 127K1, 127C, 127M, and 127Y.

The timing belt 29 is looped over the driving pulley 28A and the driven pulley 28B. The main scanning motor 27 rotates the driving pulley 28A. The rotating driving pulley 28A rotates the timing belt 29. The rotating timing belt 29 rotates the driven pulley 28B. The carriage 23 is attached to the timing belt 29. Thus, the main scanning motor 27 moves the carriage 23 via the driving pulley 28A, the driven pulley 28B, and the timing belt 29 in a main scanning direction (i.e., directions B).

The recording heads 24 are mounted on the carriage 23 and discharge liquid drops in a shuttle method. For example, while a sheet P is conveyed on the conveying belt 31 in a sub-scanning direction (i.e., a sheet conveyance direction or a direction C), the recording heads 24 mounted on the carriage 23 and moving in the directions B discharge liquid drops onto the sheet P. However, the recording heads 24 may be configured to discharge liquid drops in a line method in which the recording heads 24 discharge liquid drops without moving in the main scanning direction.

The recording heads 24 include five liquid drop discharging heads. Two of the liquid drop discharging heads (i.e., the liquid drop discharging heads 24K2 and 24K1) discharge a black ink. The other liquid drop discharging heads (i.e., the liquid drop discharging heads 24C, 24M, and 24Y) discharge cyan, magenta, and yellow inks, respectively. The black, cyan, magenta, and yellow inks are supplied from the sub tanks 25 (depicted in FIG. 1) mounted on the carriage 23, respectively.

Multiple types of the recording heads 24, such as piezo, thermal, and electrostatic types, may be used. The piezo type recording head uses a piezoelectric element as a pressure generator (e.g., an actuator) for applying pressure on ink in an ink flow route (e.g., a pressure generating room) to deform a vibration board forming walls of the ink flow route, so that a changed volume of the ink flow route discharges an ink drop. The thermal type recording head uses a heat generating resistance body to generate a bubble by boiling ink in an ink flow route, so that pressure of the bubble discharges an ink drop. The electrostatic type recording head uses a vibration board forming walls of an ink flow route and an electrode, which oppose each other, so that the vibration board deformed by an electrostatic force generated between the vibration board and the electrode changes a volume of the ink flow route and discharges an ink drop.

The maintenance-recovery mechanism 121 is disposed in a non-printing area near one end of the carriage guide 21 in the main scanning direction, and maintains and recovers conditions of nozzles of the recording heads 24. The five moisture retention caps 122K2, 122K1, 122C, 122M, and 122Y cap the nozzles of the five liquid drop discharging heads 24K2, 24K1, 24C, 24M, and 24Y, respectively. The sucking cap 123 sucks liquid drops from the liquid drop discharging heads 24K2, 24K1, 24C, 24M, and 24Y. The wiper blade 124 wipes the nozzles of the recording heads 24. The idle discharge receiver 125 receives a liquid drop which is discharged during idle discharge and is not used for printing.

The idle discharge receiver 126 is disposed in another non-printing area near the other end of the carriage guide 21 in the main scanning direction. The openings 127K2, 127K1, 127C, 127M, and 127Y receive liquid drops that are discharged from the recording heads 24 during idle discharge and are not used for printing. For example, the openings 127K2, 127K1, 127C, 127M, and 127Y receive liquid drops discharged from the liquid drop discharging heads 24K2, 24K1, 24C, 24M, and 24Y, respectively.

The sub-scanning motor 131 rotates the timing belt 132. The rotating timing belt 132 rotates the timing roller 133. The rotating timing roller 133 rotates the conveying roller 32. The rotating conveying roller 32 rotates the conveying belt 31 in the sheet conveyance direction (i.e., the sub-scanning direction or the direction C). The conveying belt 31 includes two layers, that is, a front layer which attracts a sheet P and a back layer which forms a medium resistive layer or a grounded layer. The front layer includes a resin material for which resistance control is not performed. For example, the front layer includes an ETFE (ethylene tetrafluororethylene) material. The back layer includes a material common to the front layer, for which resistance control is performed by using a carbon. However, the conveying belt 31 may include one layer or three or more layers.

Figure 3:
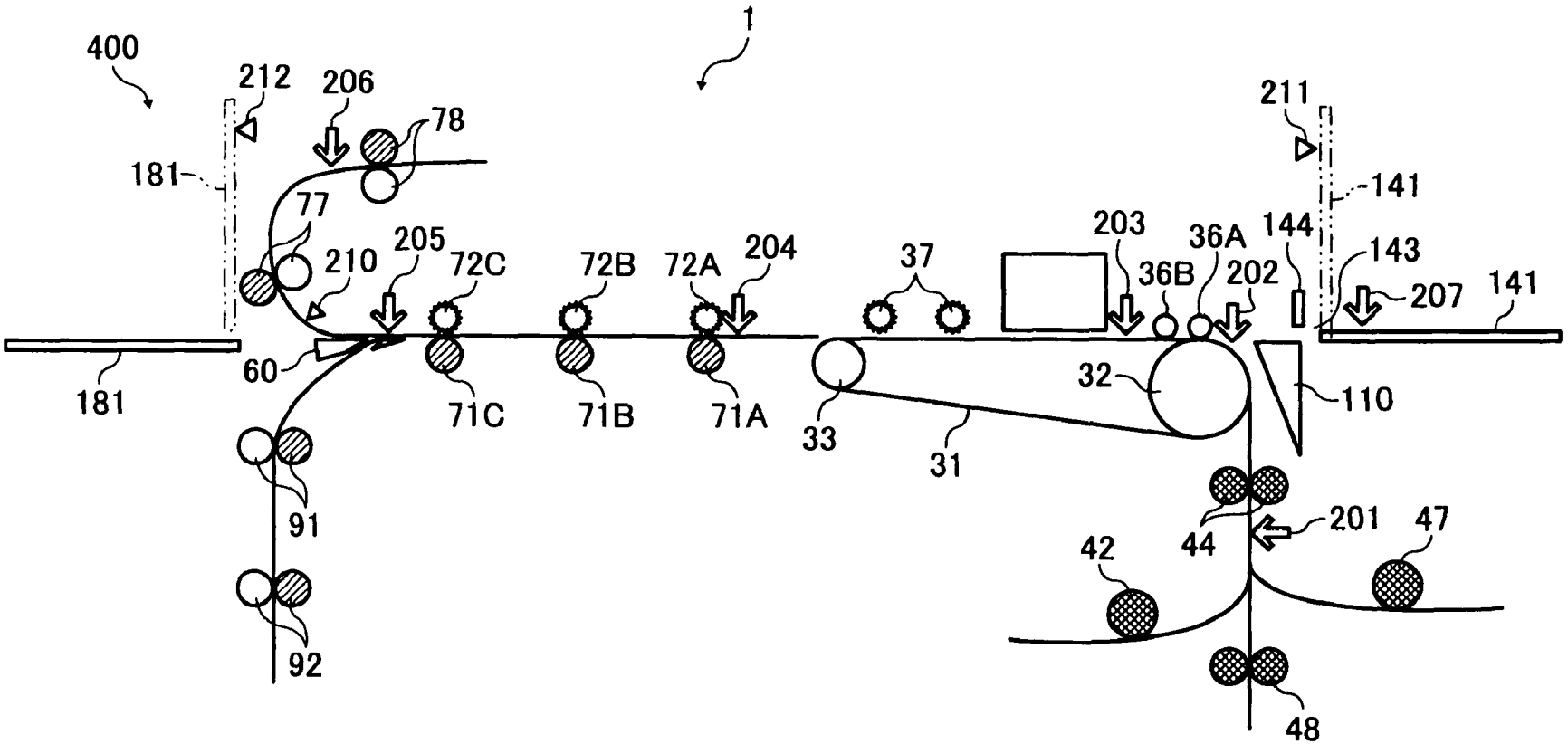
FIG. 3 is a side view of sensors of the image forming apparatus shown in FIG. 1.

Referring to FIG. 3, the following describes sensors included in the image forming apparatus 1. As illustrated in FIG. 3, the image forming apparatus 1 further includes a convey-registration sensor 201, a print-entrance sensor 202, a print-registration sensor 203, a print-exit sensor 204, a branch sensor 205, an output sensor 206, a bypass sheet sensor 207, a bypass tray sensor 211, a straight output tray sensor 212, and a sheet sensor 210.

The convey-registration sensor 201, the print-entrance sensor 202, the print-registration sensor 203, the print-exit sensor 204, the branch sensor 205, the output sensor 206, and the bypass sheet sensor 207 detect a sheet P. The convey-registration sensor 201 is disposed upstream from the registration roller pair 44 in a sheet conveyance direction. The print-entrance sensor 202 is disposed upstream from the conveying roller 32 and the pressing roller 36A in the sheet conveyance direction. The print-registration sensor 203 is disposed downstream from the pressing roller 36B (i.e., an entrance to the image forming device 2) in the sheet conveyance direction. The print-registration sensor 203 detects a sheet P so that the sheet P is sent to the image forming device 2 at a proper time when an image is formed on the sheet P. The print-exit sensor 204 is disposed upstream from the conveying roller 71A (i.e., an exit from the image forming device 2) in the sheet conveyance direction. The branch sensor 205 is disposed upstream from the switching mechanism 60 in the sheet conveyance direction. The output sensor 206 is disposed upstream from the output roller pair 78 in the sheet conveyance direction. The bypass sheet sensor 207 is disposed above the bypass tray 141 to detect a sheet P set on the bypass tray 141.

The bypass tray sensor 211 detects whether the bypass tray 141 is opened or closed. The straight output tray sensor 212 detects whether the straight output tray 181 is opened or closed. An entrance sensor (not shown) is disposed at an entrance to the horizontal path 90A (depicted in FIG. 1). A reverse sensor (not shown) is disposed at a position between an exit from the horizontal path 90A and an entrance to the switchback path 90B (depicted in FIG. 1) in the sheet conveyance direction.

The sheet sensor 210 is disposed at a position between a nip formed by the conveying roller 71C and the spur roller 72C and the downstream conveying roller pair 77 in the sheet conveyance direction. The sheet sensor 210 detects a convey condition of a sheet P (i.e., a decreased slack of a sheet P). The conveying roller 71C and the spur roller 72C serve as an upstream conveying roller pair. The downstream conveying roller pair 77 serves as a downstream conveying roller pair.

Figure 4:
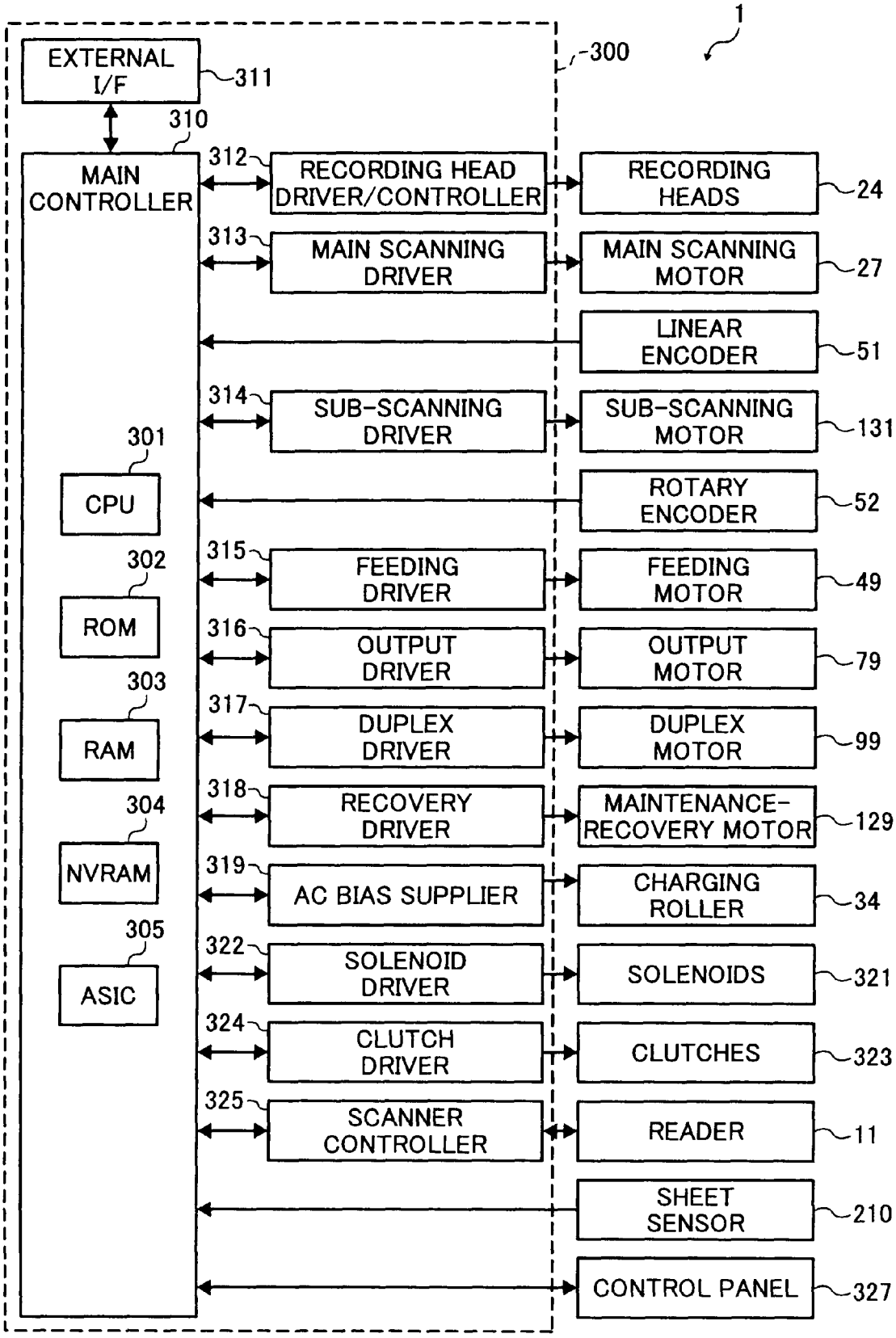
FIG. 4 is a block diagram of a controller of the image forming apparatus shown in FIG. 1.

Referring to FIG. 4, the following describes the controller 300. As illustrated in FIG. 4, the image forming apparatus 1 further includes an output motor 79, a duplex motor 99, a maintenance-recovery motor 129, solenoids 321, clutches 323, a control panel 327, a linear encoder 51, and a rotary encoder 52. The controller 300 includes a main controller 310, an external I/F (interface) 311, a recording head driver/controller 312, a main scanning driver 313, a sub-scanning driver 314, a feeding driver 315, an output driver 316, a duplex driver 317, a recovery driver 318, an AC (alternating current) bias supplier 319, a solenoid driver 322, a clutch driver 324, and a scanner controller 325. The main controller 310 includes a CPU (central processing unit) 301, a ROM (read-only memory) 302, a RAM (random access memory) 303, a NVRAM (nonvolatile random access memory) 304, and an ASIC (application-specific integrated circuit) 305.

The main controller 310 controls operations of the image forming apparatus 1. The CPU 301 executes a program. The ROM 302 stores the program executed by the CPU 301 and other data. The RAM 303 temporarily stores data (e.g., image data). The NVRAM 304 stores data even when the image forming apparatus 1 is powered off. The ASIC 305 performs signal processing for processing various signals relating to image data and input/output signals used for image processing (e.g., image arrangement) and controlling the entire image forming apparatus 1.

The external I/F 311 interfaces the main controller 310 with a host (not shown), and sends and receives data and signals. The recording head driver/controller 312 (e.g., a recording head driver provided in the recording heads 24) drives and controls the recording heads 24. The main scanning driver 313 (e.g., a motor driver) drives the main scanning motor 27 for moving the carriage 23 (depicted in FIG. 2). The sub-scanning driver 314 drives the sub-scanning motor 131. The feeding driver 315 drives the feeding motor 49. The output driver 316 drives the output motor 79 for driving various rollers included in the output conveyer 7 (depicted in FIG. 1). The duplex driver 317 drives the duplex motor 99 for driving various rollers included in the duplex unit 10 (depicted in FIG. 1). The recovery driver 318 drives the maintenance-recovery motor 129 for driving the maintenance-recovery mechanism 121 (depicted in FIG. 2). The AC (alternating current) bias supplier 319 supplies an alternating current bias to the charging roller 34. The solenoid driver 322 drives the solenoids 321 (e.g., various solenoids included in the image forming apparatus 1). The clutch driver 324 drives the clutches 323 (e.g., electromagnetic clutches for feeding a sheet P). The scanner controller 325 controls the reader 11.

The main controller 310 receives detection signals output by various sensors (depicted in FIG. 3) including detection signals output by the sheet sensor 210. The control panel 327 includes keys (e.g., a numeric keypad and a print start key) and a display. The main controller 310 receives information sent from the control panel 327 and sends information to be displayed on the control panel 327 to the control panel 327.

The linear encoder 51 includes a linear scale (not shown) and a photo sensor (not shown). The linear scale is provided in the main scanning direction to detect a position of the carriage 23 (depicted in FIG. 2), a distance for which the carriage 23 moves, and a speed at which the carriage 23 moves. The photo sensor is provided on the carriage 23. The linear encoder 51 sends a detection signal to the main controller 310. The main controller 310 controls driving of the main scanning motor 27 via the main scanning driver 313 based on the detection signal so as to move the carriage 23.

The rotary encoder 52 includes a code wheel (not shown) and a photo sensor (not shown). The code wheel is provided on a shaft (not shown) of the conveying roller 32 (depicted in FIG. 3). The photo sensor includes an encoder sensor. The rotary encoder 52 sends a pulse signal to the main controller 310. The main controller 310 controls driving of the sub-scanning motor 131 via the sub-scanning driver 314 based on the pulse signal so as to move the conveying belt 31 (depicted in FIG. 3) via the conveying roller 32.

Referring to FIG. 1, the following describes an image forming operation of the image forming apparatus 1. The AC bias supplier 319 (depicted in FIG. 4) applies a high voltage (e.g., an alternating voltage having positive and negative polarities and a square wave) to the charging roller 34. The charging roller 34 contacts an insulating layer (i.e., a surface layer) of the conveying belt 31. Thus, electric charges having positive and negative polarities respectively are applied to the surface layer of the conveying belt 31 alternately in a sheet conveyance direction. Namely, the conveying belt 31 is charged to have a predetermined charge width. Thus, an uneven electric field is generated.

A sheet P is sent from the paper tray unit 4, the bypass tray 46, the duplex unit 10, or the bypass tray 141 onto the conveying belt 31 (i.e., a nip formed by the pressing roller 36A and the conveying roller 32 via the conveying belt 31). The electric charges applied by the charging roller 34 and having positive and negative polarities generate the uneven electric field on the conveying belt 31. The sheet P is instantly polarized in accordance with a direction of the electric field. An electrostatic force on the conveying belt 31 attracts the sheet P. Thus, the rotating conveying belt 31 conveys the sheet P.

While the conveying belt 31 intermittently conveys the sheet P, the recording heads 24 discharge liquid drops onto the sheet P according to image data generated by the reader 11 to form an image on the sheet P. The separating nail 38 contacts a foremost head of the sheet P bearing the image in the sheet conveyance direction to separate the sheet P from the conveying belt 31. The output conveyer 7 outputs the sheet P onto the output tray 8 or the straight output tray 181. Alternatively, the sheet P is sent to the duplex unit 10 and reversed. After the image forming device 2 forms an image on the other side of the sheet P, the sheet P is output onto the output tray 8 or the straight output tray 181.

Figure 5:
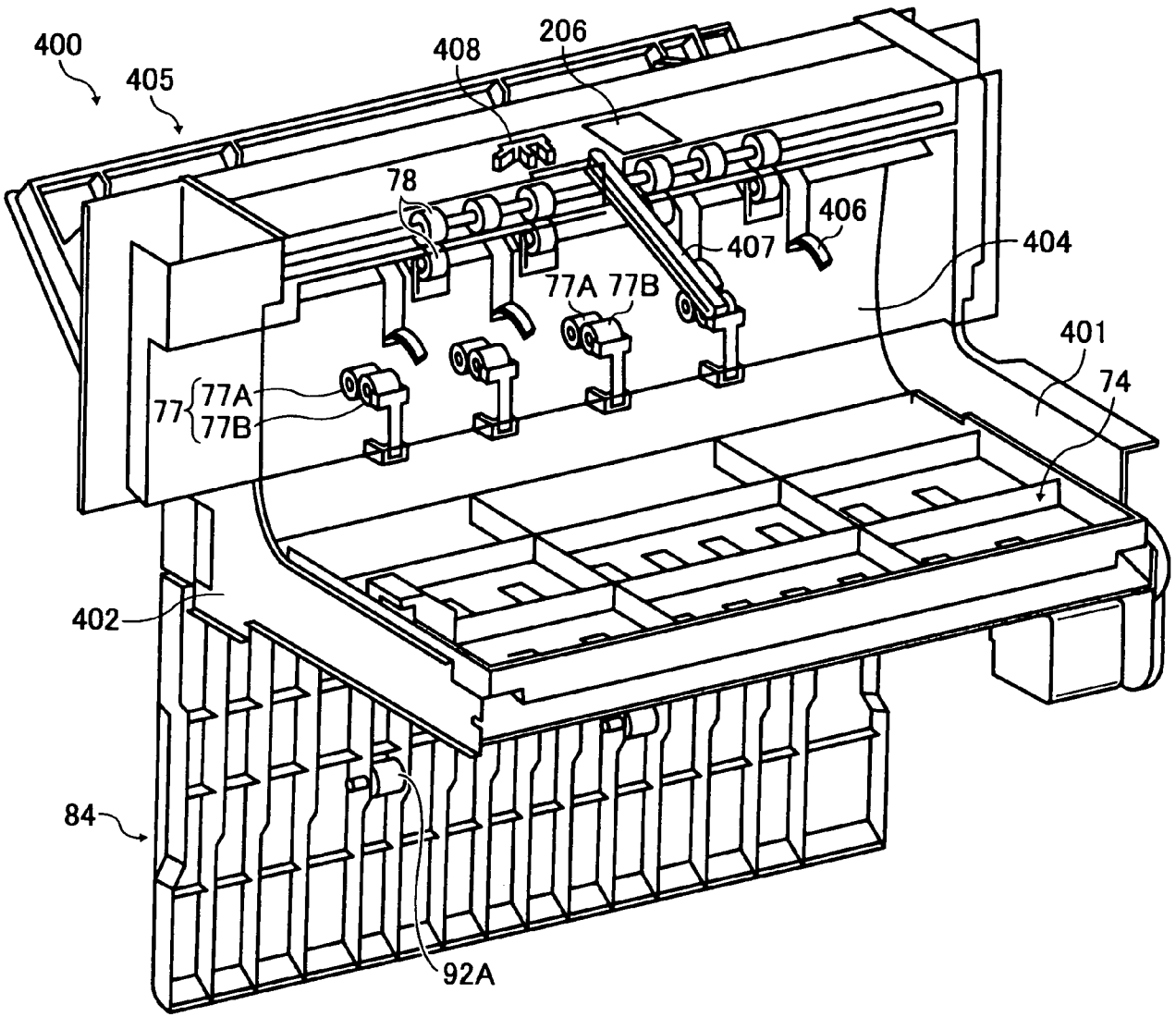
FIG. 5 is an inner perspective view of an output device of the image forming apparatus shown in FIG. 1.
Figure 6:
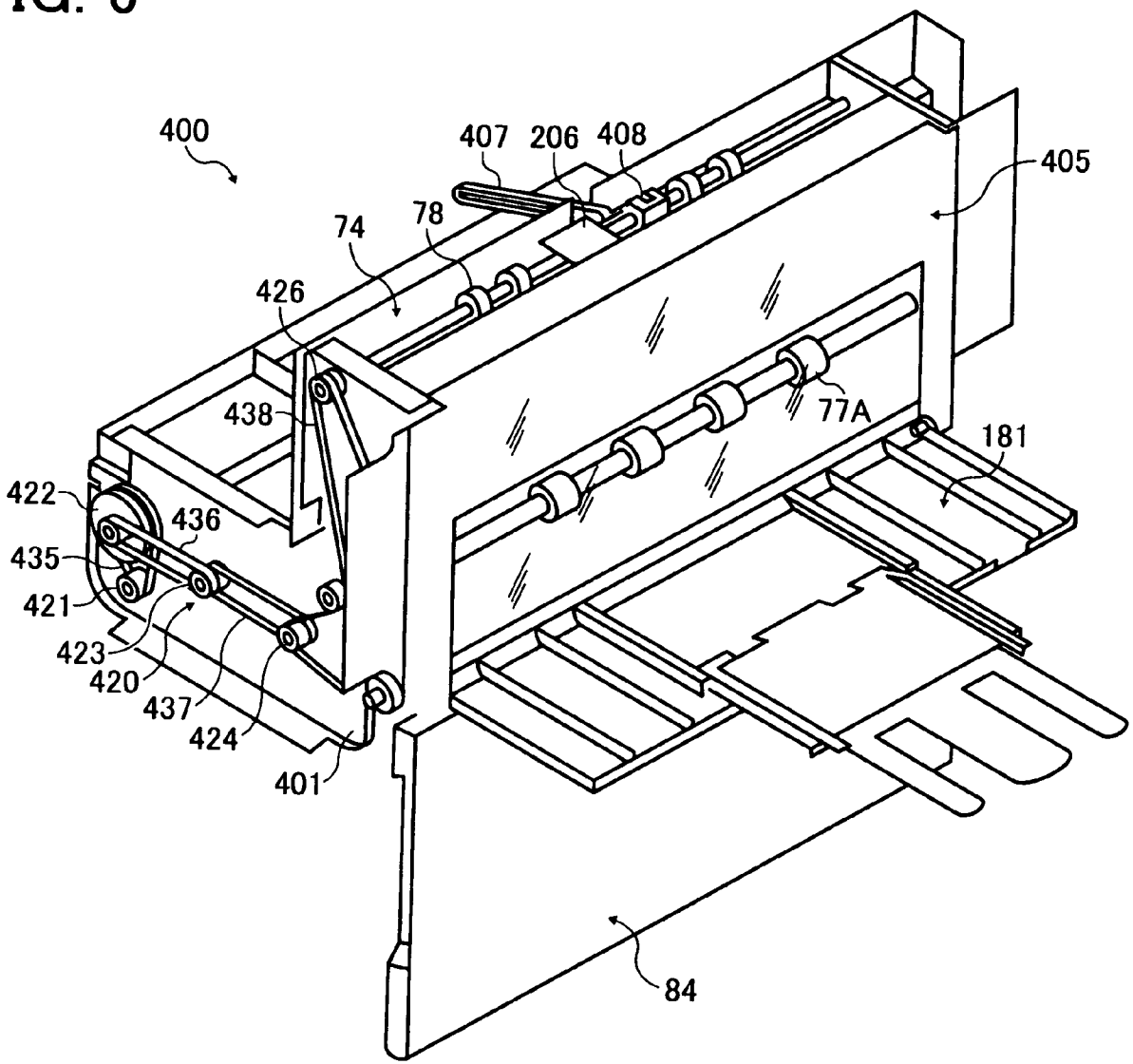
FIG. 6 is an outer perspective view of the output device shown in FIG. 5.
Figure 7:
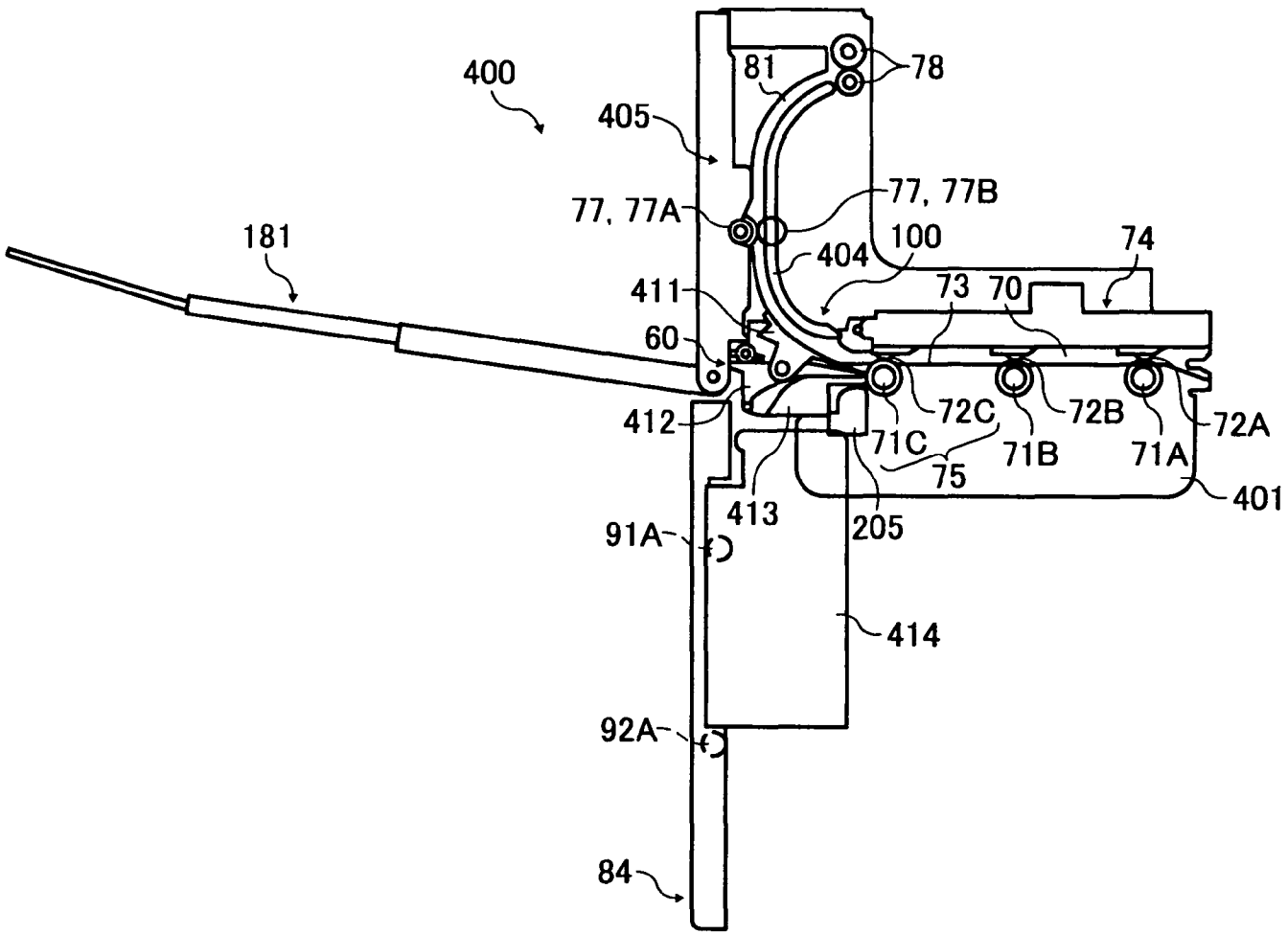
FIG. 7 is a sectional front view of the output device shown in FIG. 5.
Figure 8:
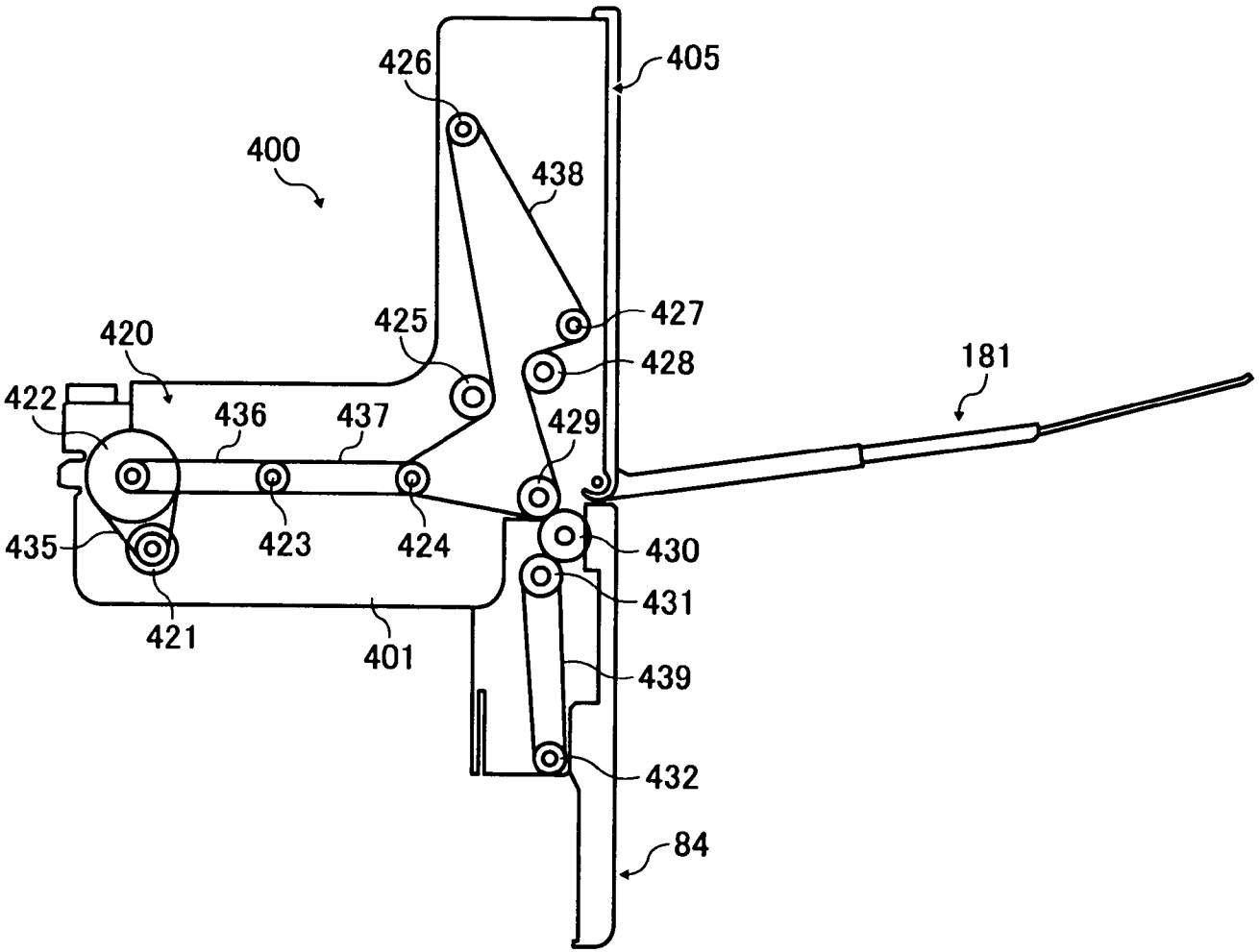
FIG. 8 is a sectional rear view of the output device shown in FIG. 5.

Referring to FIGS. 5 to 8, the following describes the output device 400. FIG. 5 is an inner perspective view of the output device 400. FIG. 6 is an outer perspective view of the output device 400. FIG. 7 is a sectional front view of the output device 400. FIG. 8 is a sectional rear view of the output device 400.

As illustrated in FIG. 5, the output device 400 further includes side plates 401 and 402, a right guide plate 404, a door 405, a pressing mechanism 406, a detecting lever 407, and a sensor 408. The downstream conveying roller pair 77 includes a conveying roller 77A and a pressing roller 77B.

As illustrated in FIGS. 5 and 7, the conveying rollers 71A through 71C, the spur rollers 72A through 72C, the lower guide 73, and the upper guide 74 (depicted in FIG. 7) are provided between the side plates 401 and 402 (depicted in FIG. 5). The spur rollers 72A-72C oppose the conveying rollers 71A-71C, respectively. While the conveying rollers 71A-71C and the spur rollers 72A-72C nip and feed a sheet P, respectively, the lower guide 73 and the upper guide 74 guide the sheet P. The upper guide 74 holds the spur rollers 72A-72C, and may be lifted and lowered.

As illustrated in FIG. 5, the right guide plate 404 is provided between the side plates 401 and 402 and forms the first output path 81 (depicted in FIG. 1). The first output path 81 reverses the sheet P guided by the upper guide 74 and the lower guide 73 (depicted in FIG. 1) and sends the sheet P onto the output tray 8 (depicted in FIG. 1) facing down. The door 405 is openable from and closable to the output device 400. The pressing mechanism 406 presses the sheet P. The detecting lever 407 and the sensor 408 form a full detecting sensor for detecting whether or not the output tray 8 is full of output sheets P. The conveying roller 77A and the pressing roller 77B oppose each other to nip and feed a sheet P. A plurality of downstream conveying roller pairs 77 are arranged in a common axial direction. The output device 400 further includes the output sensor 206 and the output roller pair 78.

As illustrated in FIG. 7, the output device 400 further includes a sheet conveying device 100, an entrance roller 91A, and an exit roller 92A. The sheet conveying device 100 includes an upstream conveying roller pair 75, the downstream conveying roller pair 77, the conveying path 70, the first output path 81, and the sub-scanning direction conveyer 3 (depicted in FIG. 1). The upstream conveying roller pair 75 includes the conveying roller 71C and the spur roller 72C. The switching mechanism 60 includes a first switching nail 411, a second switching nail 412, a guide 413, and a branch solenoid 414.

The entrance roller 91A is included in the entrance roller pair 91 (depicted in FIG. 1) and is rotatably supported by the guide plate 84. The exit roller 92A is included in the exit roller pair 92 (depicted in FIG. 1) and is rotatably supported by the guide plate 84. The upstream conveying roller pair 75 is provided in an exit from the conveying path 70. The output device 400 further includes the switching mechanism 60, the straight output tray 181, and the guide plate 84. The switching mechanism 60 guides a sheet P towards one of the first output path 81 for conveying the sheet P towards the output tray 8 (depicted in FIG. 1), the second output path 82 (depicted in FIG. 1) for conveying the sheet P onto the straight output tray 181, and the duplex unit 10 (depicted in FIG. 1).

In the switching mechanism 60, the first switching nail 411 moves to guide a sheet P towards the first output path 81 or the second output path 82. The second switching nail 412 moves to guide a sheet P towards the duplex unit 10. The guide 413 guides a sheet P to the duplex unit 10. The branch solenoid 414 drives the second switching nail 412. For example, when the branch solenoid 414 is turned off and the straight output tray 181 is closed, a sheet P is guided towards the first output path 81. When the straight output tray 181 is opened, the first switching nail 411 is moved via an interlock mechanism (not shown) so that an opening for guiding a sheet P towards the second output path 82 is provided between an upstream portion of the first switching nail 411 in the sheet conveyance direction and the second switching nail 412. When the branch solenoid 414 is driven, the second switching nail 412 is moved so that an opening for guiding a sheet P towards the duplex unit 10 is provided between an upstream portion of the second switching nail 412 in the sheet conveyance direction and the guide 413.

As illustrated in FIG. 6, the output device 400 further includes a driving mechanism 420. The driving mechanism 420 includes an output motor 421, a double pulley 422, timing belts 435 to 438, and pulleys 423, 424, and 426.

The driving mechanism 420 is provided on the side plate 401 and drives the rollers included in the output device 400. The output motor 421 generates a driving force. The double pulley 422 transmits the driving force to the conveying rollers 71A, 71B, and 71C (depicted in FIG. 7). The timing belt 435 is looped over the output motor 421 and the double pulley 422. The timing belt 436 is looped over the double pulley 422 and the pulley 423. The timing belt 437 is looped over the pulley 423 and the pulley 424. The timing belt 438 is looped over the pulley 424 and the pulley 426. The pulley 426 transmits the driving force to the output roller pair 78.

As illustrated in FIG. 8, the driving mechanism 420 further includes pulleys 427, 431, and 432, a timing belt 439, and intermediate pulleys 425, 428, 429, and 430.

The timing belt 438 is looped over the pulleys 424, 426, and 427, and the intermediate pulleys 425, 428, and 429. The pulley 427 transmits the driving force to the downstream conveying roller pair 77 (depicted in FIG. 1). The intermediate pulley 430 transmits the driving force received from the timing belt 438 to the timing belt 439. The timing belt 439 is looped over the pulley 431 and the pulley 432. The pulleys 431 and 432 transmit the driving force to the entrance roller pair 91 and the exit roller pair 92 (depicted in FIG. 1).

Referring to FIG. 1, the following describes convey paths included in the image forming apparatus 1. As described above, the image forming apparatus 1 includes a print-convey path (i.e., the sub-scanning direction conveyer 3) for opposing the image forming device 2 and conveying a sheet P while the image forming device 2 forms an image on the sheet P, a horizontal convey path (i.e., the conveying path 70) for conveying the sheet P bearing the image sent from the print-convey path in a horizontal direction, and a reverse-convey path (i.e., the first output path 81) for reversing and conveying the sheet P bearing the image sent from the horizontal convey path.

The print-convey path, the horizontal convey path, and the reverse-convey path have a print-convey force, a horizontal convey force, and a reverse-convey force for conveying a sheet P, respectively. The reverse-convey force is greater than the horizontal convey force. The print-convey force is greater than the reverse-convey force.

The print-convey force is greater than the reverse-convey force and the horizontal convey force. Thus, the horizontal convey path and the reverse-convey path disposed downstream from the print-convey path in the sheet conveyance direction may have a decreased influence on a precision with which the print-convey path conveys a sheet P. Accordingly, the print-convey path may convey a sheet P with an increased precision, resulting in formation of a high quality image.

The print-convey path, the horizontal convey path, and the reverse-convey path have a print-convey speed, a horizontal convey speed, and a reverse-convey speed at which the print-convey path, the horizontal convey path, and the reverse-convey path convey a sheet P, respectively. The horizontal convey speed is greater than the print-convey speed. The reverse-convey speed is greater than the print-convey speed.

The horizontal convey path and the reverse-convey path disposed downstream from the print-convey path in the sheet conveyance direction may have a decreased influence on a precision with which the print-convey path conveys a sheet P. Accordingly, the print-convey path may convey a sheet P with an increased precision, resulting in formation of a high quality image.

As described below, the downstream conveying roller pair 77 provided on the reverse-convey path has a pressing force which is adjustable. The horizontal convey path is provided between the print-convey path and the reverse-convey path in the sheet conveyance direction. Accordingly, change in the reverse-convey force of the reverse-convey path may have a decreased influence on a precision with which the print-convey path conveys a sheet P. Thus, the print-convey path may convey a sheet P with an increased precision, resulting in formation of a high quality image.

Figure 9:
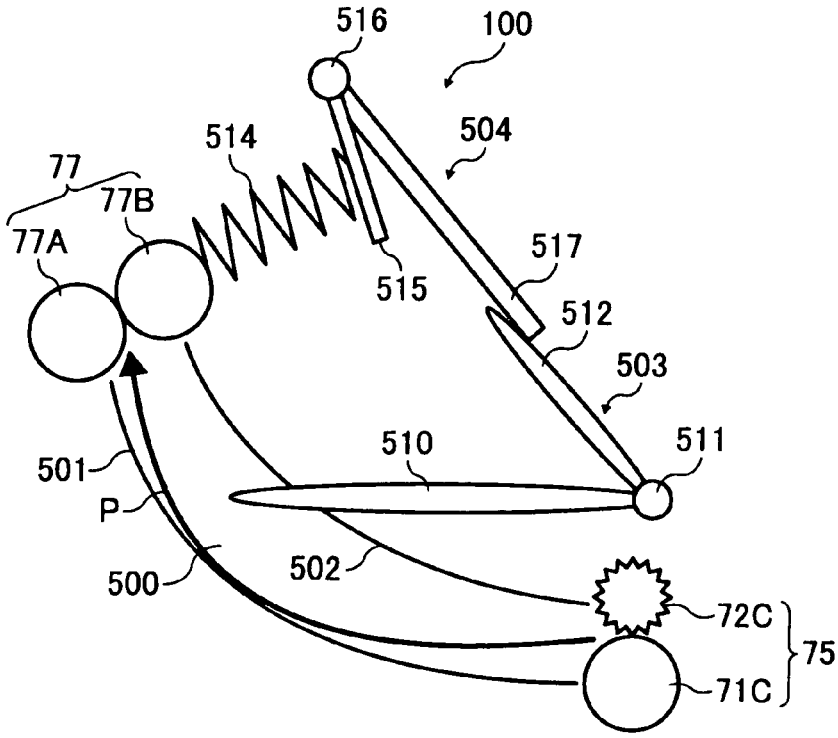
FIG. 9 is a sectional view of a sheet conveying device of the output device shown in FIG. 7, according to an exemplary embodiment.
Figure 10:
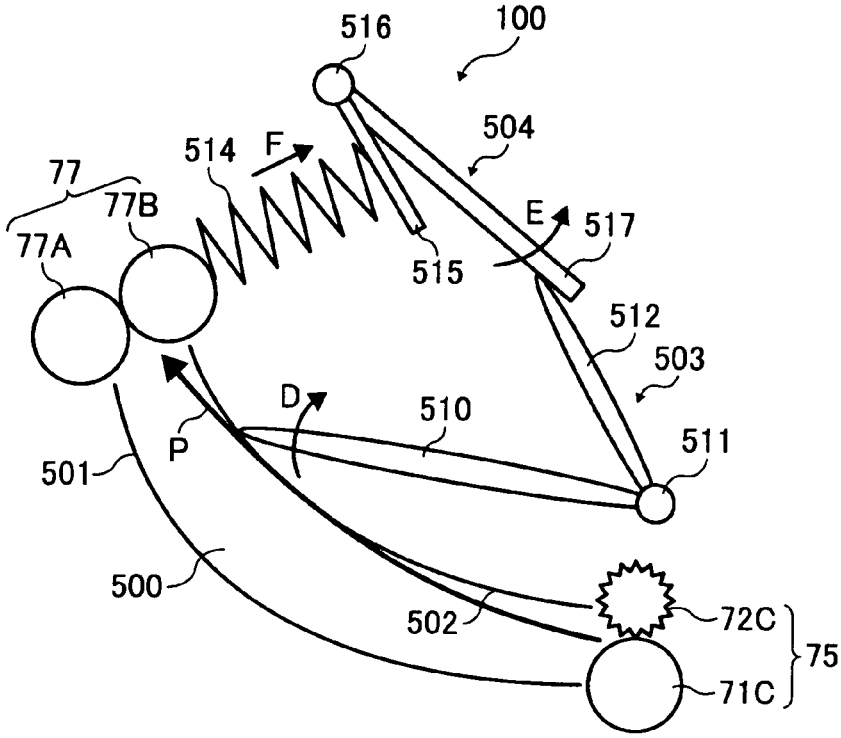
FIG. 10 is a sectional view of the sheet conveying device shown in FIG. 9, during a pressure adjustment operation.

Referring to FIGS. 9 and 10, the following describes the sheet conveying device 100. As illustrated in FIGS. 9 and 10, the sheet conveying device 100 further includes a conveying path 500, guides 501 and 502, a moving mechanism 503, and a pressure adjuster 504. The moving mechanism 503 includes a contact arm 510, a shaft 511, and a driving arm 512. The pressure adjuster 504 includes a spring 514, a holder 515, a shaft 516, and an engaging arm 517.

The upstream conveying roller pair 75 including the conveying roller 71C and the spur roller 72C is disposed upstream from the downstream conveying roller pair 77 in the sheet conveyance direction and serves as an upstream conveying roller pair for conveying a sheet P. The downstream conveying roller pair 77 including the conveying roller 77A and the pressing roller 77B is disposed downstream from the upstream conveying roller pair 75 in the sheet conveyance direction and serves as a downstream conveying roller pair for conveying a sheet P. The conveying roller 77A serves as a first roller and the pressing roller 77B serves as a second roller for opposing the first roller by applying a pressure to the first roller via the sheet P. The conveying path 500 is provided between the upstream conveying roller pair 75 and the downstream conveying roller pair 77 in the sheet conveyance direction and has a curvature. The guides 501 and 502 form the conveying path 500. The moving mechanism 503 serves as a sheet condition detector for detecting a convey condition of a sheet P conveyed between the upstream conveying roller pair 75 and the downstream conveying roller pair 77 while the sheet P is nipped by the upstream conveying roller pair 75 and the downstream conveying roller pair 77. The pressure adjuster 504 adjusts a pressure applied by the pressing roller 77B to the conveying roller 77A in accordance with movement of the moving mechanism 503.

A sheet P contacts a head (i.e., a contact portion) of the contact arm 510 when the sheet P is conveyed with a predetermined convey condition (i.e., when the slack of the sheet P is decreased). The shaft 511 rotatably supports the contact arm 510. For example, a tail of the contact arm 510 is fixed to the shaft 511. A tail of the driving arm 512 is fixed to the shaft 511. When the shaft 511 rotates, the driving arm 512 rotates to move the pressure adjuster 504.

The spring 514 applies a force to the pressing roller 77B for pressing the conveying roller 77A. The holder 515 holds a tail of the spring 514. The shaft 516 rotatably supports the holder 515. For example, one end of the holder 515 is fixed to the shaft 516. A tail of the engaging arm 517 is fixed to the shaft 516. A head of the engaging arm 517 engages with the driving arm 512 of the moving mechanism 503.

The conveying path 500 disposed upstream from the downstream conveying roller pair 77 in the sheet conveyance direction has a curvature. Therefore, a sheet P fed by the upstream conveying roller pair 75 is conveyed along the guide 501. Before the sheet P touches the downstream conveying roller pair 77, the sheet P is slacked. When the sheet P touches the downstream conveying roller pair 77, the sheet P is nipped and fed by the conveying roller 77A and the pressing roller 77B.

The upstream conveying roller pair 75 conveys a sheet P at a speed greater than a speed at which the downstream conveying roller pair 77 conveys the sheet P. Thus, the sheet P is conveyed from the upstream conveying roller pair 75 to the downstream conveying roller pair 77 in a state that the sheet P is slacked as illustrated in FIG. 9.

However, the speed and the force of the downstream conveying roller pair 77 for drawing a sheet P may become relatively greater than the speed and the force of the upstream conveying roller pair 75 for sending out the sheet P due to change in speed of the upstream conveying roller pair 75, the downstream conveying roller pair 77, and/or any roller disposed upstream from the upstream conveying roller pair 75 in the sheet conveyance direction. In this case, the slack of the sheet P may be decreased and thereby the sheet P may be tensioned between the upstream conveying roller pair 75 and the downstream conveying roller pair 77 as illustrated in FIG. 10. The sheet P may easily slip on the downstream conveying roller pair 77. As a result, an image on the sheet P may be scraped and stained.

As illustrated in FIG. 10, when the slack of the sheet P is decreased, the sheet P contacts the head of the contact arm 510 and thereby rotates the contact arm 510 in a direction D. The rotating contact arm 510 rotates the driving arm 512 via the shaft 511 in a direction common to the direction D.

The rotating driving arm 512 engages with the engaging arm 517 and thereby rotates the engaging arm 517 in a direction E. The rotating engaging arm 517 rotates the holder 515 via the shaft 516 in a direction common to the direction E. The rotating holder 515, which holds the tail of the spring 514, moves the spring 514 in a direction F. Thus, the force applied by the spring 514 to the pressing roller 77B decreases.

Consequently, the force applied by the pressing roller 77B to the conveying roller 77A also decreases. The downstream conveying roller pair 77 nips the sheet P by applying a decreased pressure to the sheet P, while preventing or reducing slippage of the sheet P on the downstream conveying roller pair 77. As a result, scraping and staining an image formed on the sheet P may be prevented or reduced.

When the downstream conveying roller pair 77 draws a sheet P with a decreased force and the sheet P is slacked again, the moving mechanism 503 and the pressure adjuster 504 rotate and move in directions opposite to the directions D, E, and F. Thus, the pressing roller 77B applies a recovered pressure to the conveying roller 77A. Sheet conveying performance of the sheet conveying device 100 decreases restrictively, resulting in stable sheet conveying performance.

As described above, a sheet conveying device (i.e., the sheet conveying device 100) includes an upstream conveying roller pair (i.e., the upstream conveying roller pair 75), a downstream conveying roller pair (i.e., the downstream conveying roller pair 77), a sheet condition detector (i.e., the moving mechanism 503), and a pressure adjuster (i.e., the pressure adjuster 504). The upstream conveying roller pair is disposed upstream from the downstream conveying roller pair in a sheet conveyance direction, and conveys a sheet (i.e., the sheet P). The downstream conveying roller pair is disposed downstream from the upstream conveying roller pair in the sheet conveyance direction, and conveys the sheet. The sheet condition detector detects a convey condition of the sheet while the sheet is nipped and conveyed by the upstream conveying roller pair and the downstream conveying roller pair. The pressure adjuster adjusts a pressure applied by at least one of the upstream conveying roller pair and the downstream conveying roller pair to the sheet based on a detection result provided by the sheet condition detector, preventing or reducing slippage of the sheet on the downstream conveying roller pair. As a result, scraping and staining an image formed on the sheet may be prevented or reduced. When the sheet is slacked again, the downstream conveying roller pair applies a recovered pressure to the sheet. Sheet conveying performance of the sheet conveying device decreases restrictively, resulting in stable sheet conveying performance.

A conveying path (i.e., the conveying path 500), disposed upstream from the downstream conveying roller pair for applying an adjusted pressure in the sheet conveyance direction, has a curvature. Before a sheet touches the downstream conveying roller pair, the sheet is guided by an outside guide having a greater curvature (i.e., the guide 501). Thus, the sheet is slacked. The sheet condition detector and the pressure adjuster may be provided near an inside guide having a smaller curvature (i.e., the guide 502), reducing malfunction of the pressure adjuster.

At least one of the upstream conveying roller pair and the downstream conveying roller pair is divided into a plurality of roller pairs in a common axial direction. The pressure adjuster may apply a decreased pressure to one of the roller pairs, providing an easier mechanical configuration.

The sheet condition detector is disposed between the divided downstream conveying roller pairs. Namely, the sheet condition detector may contact a sheet nipped by the divided downstream conveying roller pairs at a position between the divided downstream conveying roller pairs. The sheet condition detector may contact a sheet with a stable pressure, resulting in a stable operation of the sheet condition detector. When the sheet condition detector is not disposed between the divided downstream conveying roller pairs, a sheet is not stably nipped and thereby the sheet condition detector may not move properly, resulting in an unstable operation of the sheet condition detector.

The pressing roller 77B applies a decreased pressure to the conveying roller 77A. Namely, the pressing roller 77B and the conveying roller 77A nip a sheet P with a decreased pressure, providing stable sheet conveying performance. If the pressing roller 77B and the conveying roller 77A are configured not to nip a sheet P, a head of the sheet P, which passes the pressing roller 77B and the conveying roller 77A, may not move stably. However, the pressing roller 77B and the conveying roller 77A may be configured not to nip a sheet P, as described below.

For example, the downstream conveying roller pair 77 nips a sheet P with a pressure (i.e., a pressure Y) greater than a contact pressure (i.e., a pressure X) with which the moving mechanism 503 contacts the sheet P. Namely, when the pressure Y is greater than the pressure X, the sheet P may be stably conveyed.

Figure 11:
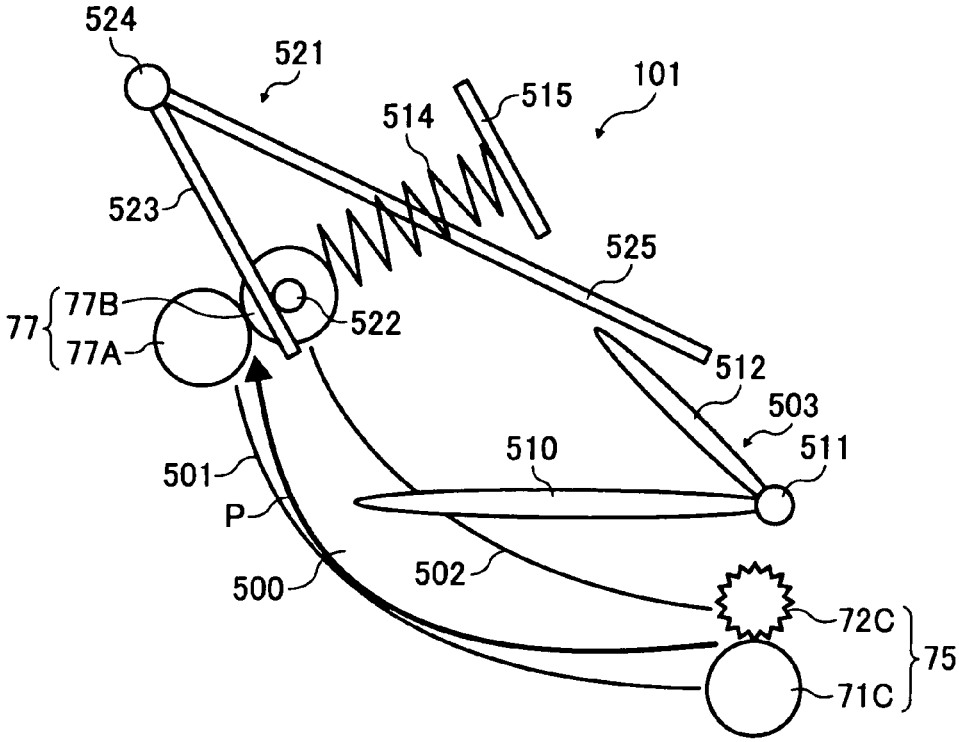
FIG. 11 is a sectional view of a sheet conveying device of the output device shown in FIG. 7, according to another exemplary embodiment.
Figure 12:
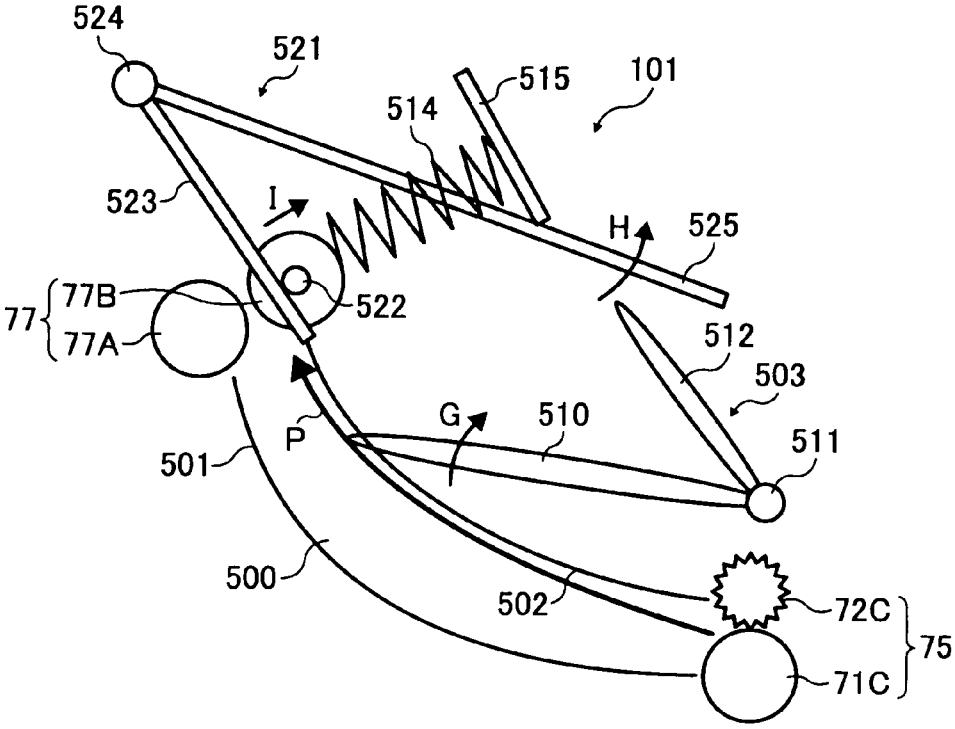
FIG. 12 is a sectional view of the sheet conveying device shown in FIG. 11, during a pressure adjustment operation.

Referring to FIGS. 11 and 12, the following describes a sheet conveying device 101 according to another exemplary embodiment. As illustrated in FIGS. 11 and 12, the sheet conveying device 101 includes a pressure adjuster 521 instead of the pressure adjuster 504 (depicted in FIG. 9). The other elements of the sheet conveying device 101 are common to the sheet conveying device 100 (depicted in FIG. 9). The pressure adjuster 521 includes the spring 514, the holder 515, a shaft 522, an arm 523, a shaft 524, and an engaging arm 525.

The pressure adjuster 521 separates the pressing roller 77B from the conveying roller 77A to release a nip formed by the pressing roller 77B and the conveying roller 77A, when the driving arm 512 is moved.

The shaft 522 supports the pressing roller 77B. The arm 523 includes a head for engaging with the shaft 522. The shaft 524 rotatably supports the arm 523. For example, a tail of the arm 523 is fixed to the shaft 524. A tail of the engaging arm 525 is fixed to the shaft 524. A head of the engaging arm 525 engages with the driving arm 512.

As illustrated in FIG. 12, when the slack of a sheet P is decreased, the sheet P contacts the head of the contact arm 510 and rotates the contact arm 510 in a direction G. The rotating contact arm 510 rotates the driving arm 512 via the shaft 511 in a direction common to the direction G.

The rotating driving arm 512 engages with the engaging arm 525 and rotates the engaging arm 525 in a direction H. The rotating engaging arm 525 moves the arm 523 via the shaft 524 in a direction I in which the pressing roller 77B separates away from the conveying roller 77A against a force applied by the spring 514.

Namely, the pressing roller 77B does not contact the conveying roller 77A. Thus, the downstream conveying roller pair 77 does not apply a pressure to a sheet P. Accordingly, the sheet P may not slip on the downstream conveying roller pair 77. As a result, an image on the sheet P may not be scraped.

Figure 13:
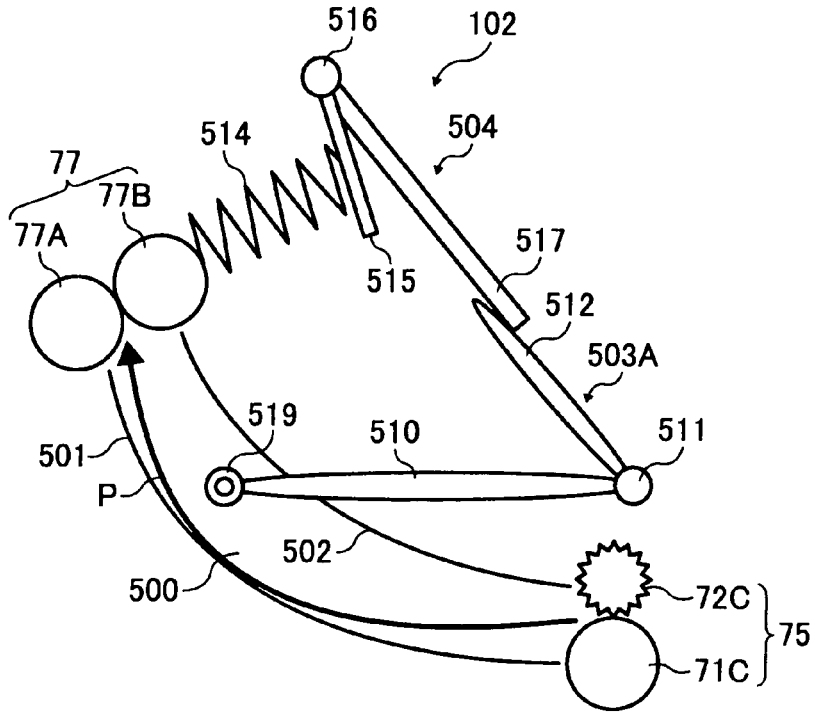
FIG. 13 is a sectional view of a sheet conveying device of the output device shown in FIG. 7, according to yet another exemplary embodiment.

Referring to FIG. 13, the following describes a sheet conveying device 102 according to yet another exemplary embodiment. As illustrated in FIG. 13, the sheet conveying device 102 includes a moving mechanism 503A instead of the moving mechanism 503 (depicted in FIG. 9). The other elements of the sheet conveying device 102 are common to the sheet conveying device 100 (depicted in FIG. 9). The moving mechanism 503A includes the contact arm 510, the shaft 511, the driving arm 512, and a roller 519.

The moving mechanism 503A serves as a sheet condition detector for detecting a convey condition of a sheet P conveyed between the upstream conveying roller pair 75 and the downstream conveying roller pair 77 while the sheet P is nipped by the upstream conveying roller pair 75 and the downstream conveying roller pair 77. The roller 519 is rotatably provided on the head (i.e., the contact portion) of the contact arm 510. Thus, when a sheet P contacts the head of the contact arm 510, the roller 519 may not damage the sheet P.

Figure 14:
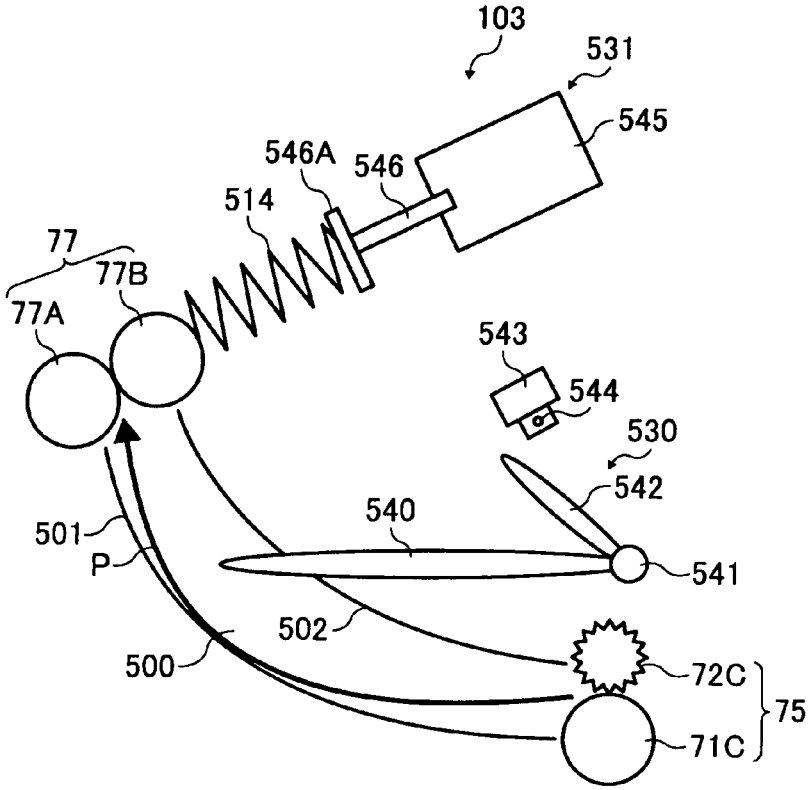
FIG. 14 is a sectional view of a sheet conveying device of the output device shown in FIG. 7, according to yet another exemplary embodiment.
Figure 15:
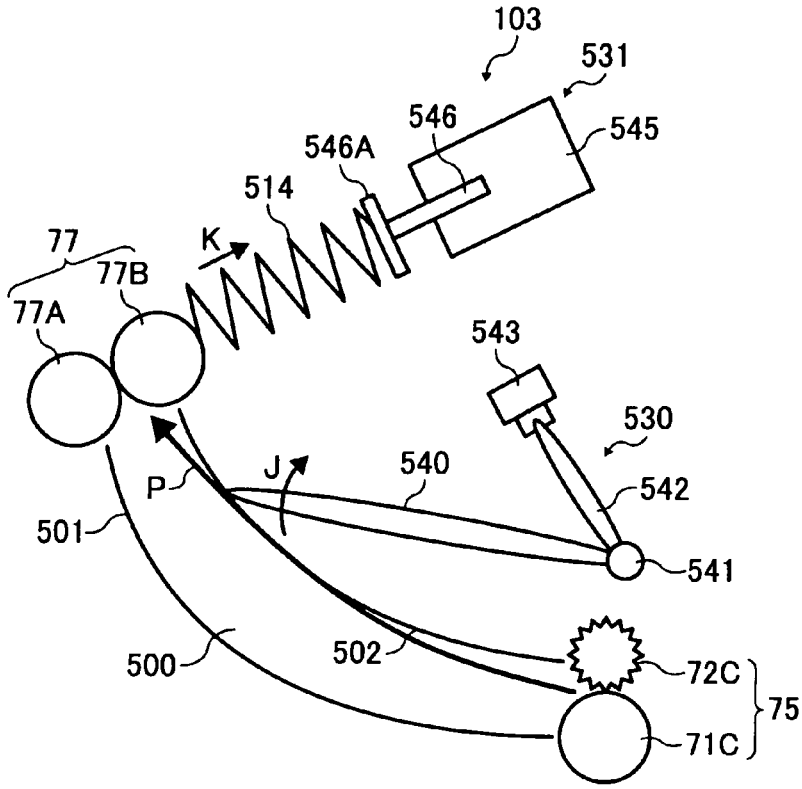
FIG. 15 is a sectional view of the sheet conveying device shown in FIG. 14, during a pressure adjustment operation.

Referring to FIGS. 14 and 15, the following describes a sheet conveying device 103 according to yet another exemplary embodiment. As illustrated in FIGS. 14 and 15, the sheet conveying device 103 includes a sheet detector 530 and a pressure adjuster 531 instead of the moving mechanism 503 and the pressure adjuster 504 (depicted in FIG. 9), respectively. The other elements of the sheet conveying device 103 are common to the sheet conveying device 100 (depicted in FIG. 9). The sheet detector 530 includes a detecting lever 540, a shaft 541, a shield arm 542, and a sheet sensor 543. The sheet sensor 543 includes an optical axis 544. The pressure adjuster 531 includes the spring 514, a solenoid 545, a plunger 546, and a holder 546A.

The sheet detector 530 serves as a sheet condition detector for detecting that a sheet P is conveyed with a predetermined convey condition. The pressure adjuster 531 is driven by the main controller 310 (depicted in FIG. 4) to adjust a pressure applied by the pressing roller 77B to the conveying roller 77A based on a detection result provided by the sheet detector 530.

The sheet detector 530 has a structure similar to the structure of the moving mechanism 503 (depicted in FIG. 9). A sheet P contacts a head (i.e., a contact portion) of the detecting lever 540 when the sheet P is conveyed with a predetermined convey condition (i.e., when the slack of the sheet P is decreased). The shaft 541 rotatably supports a tail of the detecting lever 540. For example, the tail of the detecting lever 540 is fixed to the shaft 541. A tail of the shield arm 542 is fixed to the shaft 541. The sheet sensor 543 is equivalent to the sheet sensor 210 (depicted in FIG. 3) and includes a transmission photo sensor. A head of the shield arm 542 shields the optical axis 544. The head of the detecting lever 540, which contacts a sheet P, may have a roller shape. For example, the roller 519 (depicted in FIG. 13) may be provided on the head of the detecting lever 540.

The plunger 546 is attached to the solenoid 545. The holder 546A is provided on a head of the plunger 546 and holds a tail of the spring 514 for applying a force to the pressing roller 77B. When the solenoid 545 is driven, the solenoid 545 pulls the plunger 546. Accordingly, the spring 514 applies a decreased force to the pressing roller 77B. Thus, the pressing roller 77B applies a decreased pressure to the conveying roller 77A.

As illustrated in FIG. 15, when the slack of a sheet P is decreased, the sheet P contacts the head of the detecting lever 540 and rotates the detecting lever 540 in a direction J. The rotating detecting lever 540 rotates the shield arm 542 via the shaft 541. The rotating shield arm 542 shields the optical axis 544 (depicted in FIG. 14) of the sheet sensor 543. Thus, the sheet sensor 543 detects that the slack of the sheet P is decreased and sends a signal to the main controller 310 (depicted in FIG. 4).

The main controller 310 drives the solenoid 545 via a driving circuit (not shown). The solenoid 545 pulls the plunger 546. The plunger 546 pulls the spring 514 in a direction K and the tail of the spring 514 moves closer to the solenoid 545. Namely, the spring 514 applies a decreased force to the pressing roller 77B. Accordingly, the pressing roller 77B applies a decreased pressure to the conveying roller 77A. Thus, the downstream conveying roller pair 77 nips the sheet P by applying a decreased pressure to the sheet P.

The sheet conveying device 103 may provide a sheet conveying performance similar to the sheet conveying performance provided by the sheet conveying device 100 (depicted in FIG. 9). A pressure applied by a sheet P contacting the detecting lever 540 does not directly change a force applied by the spring 514 to the pressing roller 77B. Even when a sheet P contacts the detecting lever 540 with a decreased pressure, the sheet detector 530 may detect a decreased slack of the sheet P. Thus, the pressure adjuster 531 may smoothly adjust a pressure applied to the pressing roller 77B.

Figure 16:
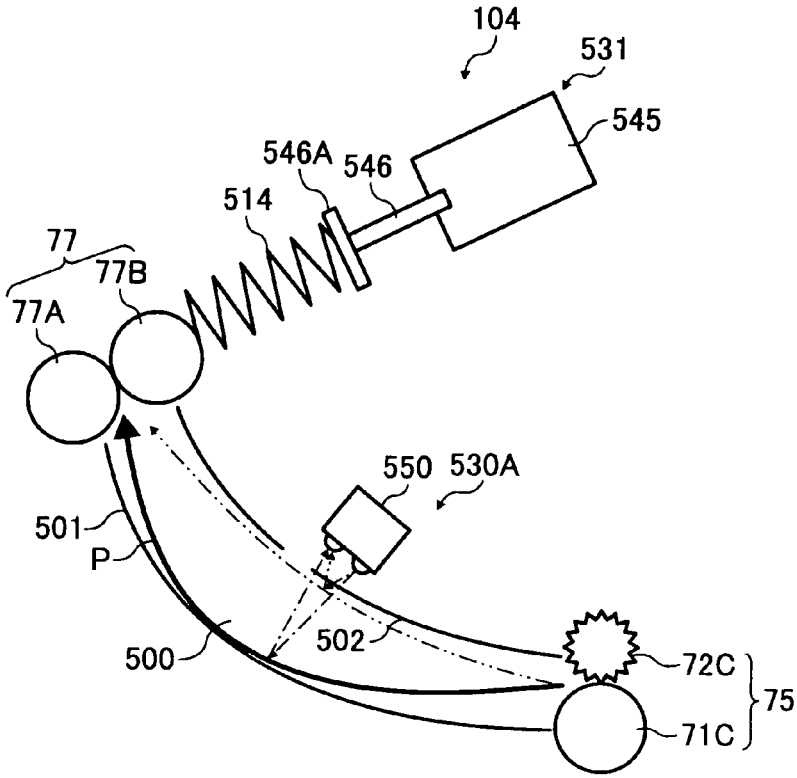
FIG. 16 is a sectional view of a sheet conveying device of the output device shown in FIG. 7, according to yet another exemplary embodiment.

Referring to FIG. 16, the following describes a sheet conveying device 104 according to yet another exemplary embodiment. As illustrated in FIG. 16, the sheet conveying device 104 includes a sheet detector 530A instead of the sheet detector 530 (depicted in FIG. 14). The sheet detector 530A includes a non-contact sheet sensor 550. The other elements of the sheet conveying device 104 are common to the sheet conveying device 103 (depicted in FIG. 14).

The sheet detector 530A serves as a sheet condition detector for detecting that a sheet P is conveyed with a predetermined convey condition. The non-contact sheet sensor 550 includes a reflection photo sensor. The pressure adjuster 531 is driven by the main controller 310 (depicted in FIG. 4) to adjust a pressure applied by the pressing roller 77B to the conveying roller 77A based on a detection result provided by the sheet detector 530A. The non-contact sheet sensor 550 outputs detection results varying depending on the position of a sheet P. For example, when the sheet P is at a position illustrated in a broken line, the non-contact sheet sensor 550 outputs a detection result different from a detection result that the non-contact sheet sensor 550 outputs when the sheet P is at a position illustrated in a solid line. Thus, the main controller 310 may recognize the convey condition of the sheet P.

Since the non-contact sheet sensor 550 does not contact a sheet P, the sheet detector 530A may detect that the sheet P is conveyed with a predetermined convey condition without damaging the sheet P.

Figure 17:
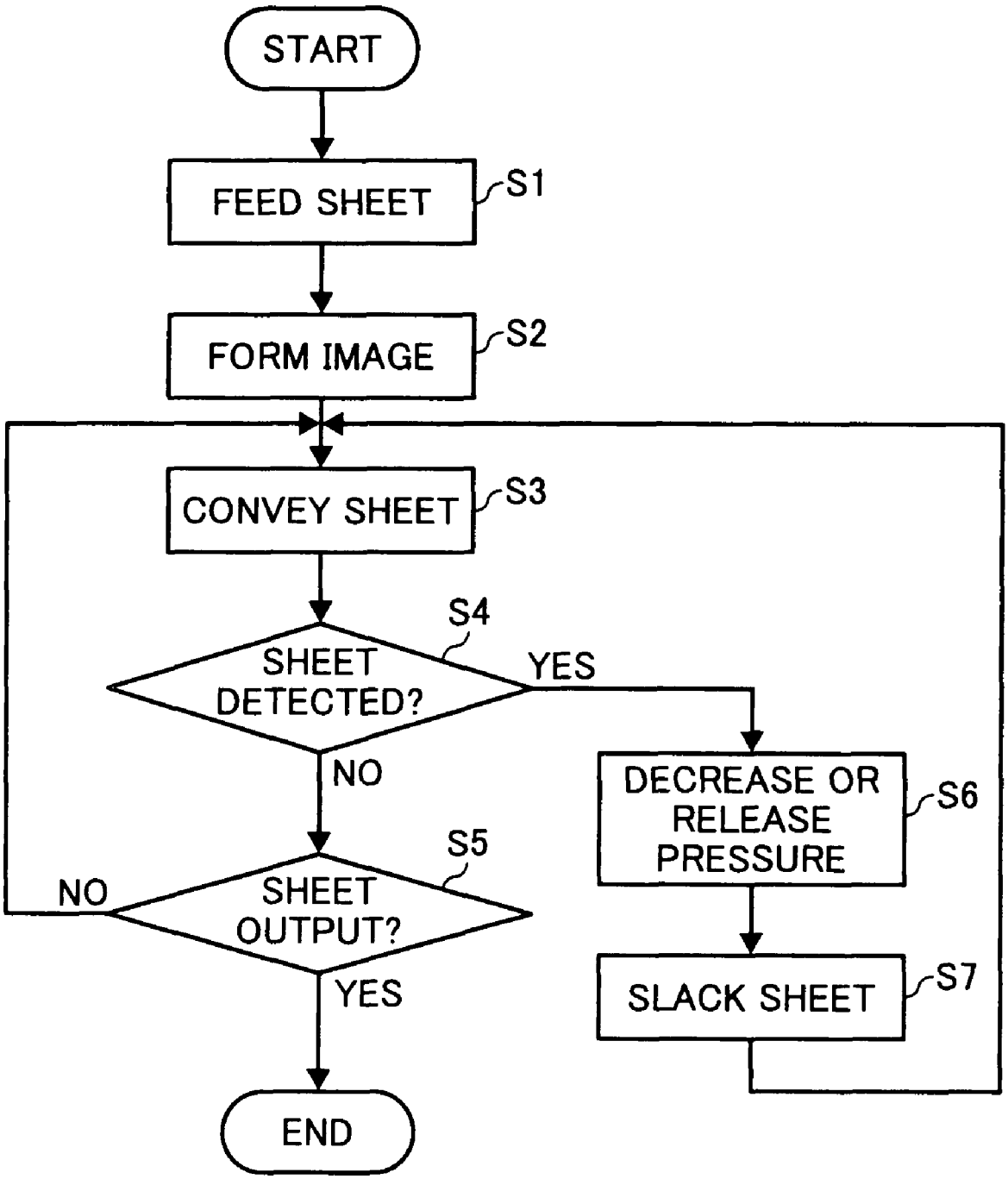
FIG. 17 is a flowchart of a pressure adjustment operation controlled by the controller shown in FIG. 4.

Referring to FIG. 17, the following describes an exemplary operation of the main controller 310 (depicted in FIG. 4) for controlling the pressure adjuster 531 (depicted in FIGS. 14 and 16).

In step S1, a sheet P is fed from the paper tray unit 4 (depicted in FIG. 1) to the image forming device 2 (depicted in FIG. 1). In step S2, the image forming device 2 forms an image on the sheet P, and sends the sheet P towards the output conveyer 7 (depicted in FIG. 1). In step S3, the output conveyer 7 conveys the sheet P bearing the image towards the output tray 8 (depicted in FIG. 1). In step S4, the main controller 310 (depicted in FIG. 4) determines whether or not the sheet detector 530 (depicted in FIG. 14) or 530A (depicted in FIG. 16) detects the sheet P. If the sheet detector 530 or 530A does not detect the sheet P (i.e., if NO is selected in step S4), the main controller 310 determines whether or not the sheet P is output onto the output tray 8 in step S5. If the sheet P is not output onto the output tray 8 (i.e., if NO is selected in step S5), the output conveyer 7 continues conveying the sheet P towards the output tray 8 in step S3.

If the sheet detector 530 or 530A detects the sheet P (i.e., if YES is selected in step S4), the slack of the sheet P is decreased. Therefore, the pressure adjuster 531 (depicted in FIGS. 14 and 16) decreases a pressure applied by the downstream conveying roller pair 77 (depicted in FIGS. 14 and 16) to the sheet P in step S6. Alternatively, the pressure adjuster 531 may release a pressure applied by the downstream conveying roller pair 77 to the sheet P. Accordingly, the slack of the sheet P is increased in step S7.

As described above, a sheet conveying device (i.e., the sheet conveying device 100, 101, 102, 103, or 104 depicted in FIG. 9, 11, 13, 14, or 16, respectively) includes a sheet condition detector (i.e., the moving mechanism 503 or 503A depicted in FIG. 9 or 13, respectively or the sheet detector 530 or 530A depicted in FIG. 14 or 16, respectively) and a pressure adjuster (i.e., the pressure adjuster 504, 521, or 531 depicted in FIG. 9, 11, or 14, respectively). The sheet condition detector detects a convey condition of a sheet when the sheet is nipped and conveyed by an upstream conveying roller pair (i.e., the upstream conveying roller pair 75 depicted in FIG. 9) and a downstream conveying roller pair (i.e., the downstream conveying roller pair 77 depicted in FIG. 9). The pressure adjuster adjusts a pressure applied by at least one of the upstream conveying roller pair and the downstream conveying roller pair to the sheet based on a detection result provided by the sheet condition detector. For example, when the slack of the sheet is decreased, the pressure adjuster adjusts the pressure applied to the sheet. Thus, the sheet conveying device may maintain a proper slack of the sheet while maintaining a proper conveying performance.

When the sheet conveying device is included in an image forming apparatus (i.e., the image forming apparatus 1 depicted in FIG. 1), a sheet bearing an image may not slip on the upstream conveying roller pair and the downstream conveying roller pair. As a result, the upstream conveying roller pair and the downstream conveying roller pair may not scrape or stain the image on the sheet and thereby the upstream conveying roller pair and the downstream conveying roller pair may not be stained.

According to the above-described exemplary embodiments, the pressure adjuster is connected with the downstream conveying roller pair to adjust a pressure applied by the downstream conveying roller pair to a sheet. However, the pressure adjuster may be connected with the upstream conveying roller pair to adjust a pressure applied by the upstream conveying roller pair to a sheet.

According to the above-described exemplary embodiments, the upstream conveying roller pair includes a spur roller (i.e., the spur roller 72C depicted in FIG. 9). However, the downstream conveying roller pair may include the spur roller.

According to the above-described exemplary embodiments, the sheet conveying device is included in a multifunction printer (MFP) serving as an image forming apparatus. However, the sheet conveying device may be included in a printer, a facsimile machine, or the like serving as an image forming apparatus. The sheet conveying device may be applied to an image forming apparatus which forms an image by using a recording liquid other than ink or by using a developer in an electrophotographic method. The sheet conveying device may be included in a device for conveying a sheet other than an image forming apparatus.

According to the above-described exemplary embodiments, a roller includes a rotating member, a rotating body, a roller, a spur, and/or the like. A roller pair includes a pair of common elements (e.g., a pair of rollers and a pair of spurs) as well as a pair of different elements (e.g., a pair of a roller and a spur). A recording medium, on which an image forming apparatus forms an image, includes paper, strings, fiber, cloth, leather, metal, plastic, glass, wood, ceramics, and/or the like. An image formed by the image forming apparatus includes a character, a letter, graphics, a pattern, and/or the like. A recording liquid, with which the image forming apparatus forms an image, is not limited to ink but includes any fluid.

Numerous additional modifications and variations are possible in light of the above teachings. It is therefore to be understood that within the scope of the appended claims, the disclosure of this patent specification may be practiced otherwise than as specifically described herein. For example, elements and/or features of different illustrative embodiments may be combined with each other and/or substituted for each other within the scope of this disclosure and appended claims.

This patent specification is based on Japanese patent application No. 2006-189144 filed on Jul. 10, 2006 in the Japan Patent Office, the entire contents of which are hereby incorporated herein by reference.

What is claimed is:

1. An image forming apparatus, comprising:

an image forming device configured to form an image on a sheet; and a sheet conveying device configured to convey the sheet bearing the image, and including an upstream conveying roller pair configured to convey the sheet, a downstream conveying roller pair disposed downstream from the upstream conveying roller pair in a sheet conveyance direction, and configured to convey the sheet, a sheet condition detector configured to detect a convey condition of the sheet when the sheet is nipped and conveyed by the upstream conveying roller pair and the downstream conveying roller pair, and a pressure adjuster configured to adjust a first pressure applied by at least one of the upstream conveying roller pair and the downstream conveying roller pair to the sheet based on a detection result provided by the sheet condition detector, wherein the upstream conveying roller pair conveys the sheet at a first speed greater than a second speed at which the downstream conveying roller pair conveys the sheet.

2. The image forming apparatus of claim 1, wherein the sheet contacts the sheet condition detector when the sheet is conveyed with a predetermined convey condition so as to move the sheet condition detector, and wherein the pressure adjuster adjusts the first pressure applied by at least one of the upstream conveying roller pair and the downstream conveying roller pair to the sheet in accordance with the movement of the sheet condition detector.

3. The image forming apparatus of claim 2, wherein at least one of the upstream conveying roller pair and the downstream conveying roller pair includes a first roller and a second roller opposing the first roller and applying a second pressure to the first roller via the sheet, and wherein the pressure adjuster performs one of separating the second roller away from the first roller and decreasing the second pressure applied by the second roller to the first roller.

4. The image forming apparatus of claim 3, wherein the sheet contacts the sheet condition detector with a third pressure smaller than the second pressure applied by the second roller to the first roller.

5. The image forming apparatus of claim 2, wherein the sheet condition detector includes a contact portion configured to contact the sheet.

6. The image forming apparatus of claim 2, wherein at least one of the upstream conveying roller pair and the downstream conveying roller pair is divided into a plurality of roller pairs in a common axial direction.

7. The image forming apparatus of claim 1, wherein the sheet condition detector detects that the sheet is conveyed with the predetermined convey condition by performing one of contacting and not contacting the sheet.

8. The image forming apparatus of claim 7, wherein at least one of the upstream conveying roller pair and the downstream conveying roller pair includes a first roller and a second roller opposing the first roller by applying a second pressure to the first roller via the sheet, and wherein the pressure adjuster performs one of separating the second roller away from the first roller and decreasing the second pressure applied by the second roller to the first roller based on a detection result provided by the sheet condition detector.

9. The image forming apparatus of claim 1, wherein the sheet conveying device further includes a conveying path having a curvature and provided between the upstream conveying roller pair and the downstream conveying roller pair in the sheet conveyance direction.

10. The image forming apparatus of claim 1, wherein at least one of the upstream conveying roller pair and the downstream conveying roller pair includes a spur roller.

11. An image forming apparatus, comprising:

an image forming device configured to form an image on a sheet; and a sheet conveying device configured to convey the sheet bearing the image, and including an upstream conveying roller pair configured to convey the sheet, a downstream conveying roller pair disposed downstream from the upstream conveying roller pair in a sheet conveyance direction, and configured to convey the sheet, a sheet condition detector configured to detect a convey condition of the sheet when the sheet is nipped and conveyed by the upstream conveying roller pair and the downstream conveying roller pair, and a pressure adjuster configured to adjust a first pressure applied by at least one of the upstream conveying roller pair and the downstream conveying roller pair to the sheet based on a detection result provided by the sheet condition detector, wherein the sheet contacts the sheet condition detector when the sheet is conveyed with a predetermined convey condition so as to move the sheet condition detector, wherein the pressure adjuster adjusts the first pressure applied by at least one of the upstream conveying roller pair and the downstream conveying roller pair to the sheet in accordance with the movement of the sheet condition detector, wherein at least one of the upstream conveying roller pair and the downstream conveying roller pair is divided into a plurality of roller pairs in a common axial direction, and wherein the sheet condition detector is provided between the divided roller pairs.

12. An image forming apparatus, comprising:

an image forming device configured to form an image on a sheet; and a sheet conveying device configured to convey the sheet bearing the image, and including an upstream conveying roller pair configured to convey the sheet, a downstream conveying roller pair disposed downstream from the upstream conveying roller pair in a sheet conveyance direction, and configured to convey the sheet, a sheet condition detector configured to detect a convey condition of the sheet when the sheet is nipped and conveyed by the upstream conveying roller pair and the downstream conveying roller pair, and a pressure adjuster configured to adjust a first pressure applied by at least one of the upstream conveying roller pair and the downstream conveying roller pair to the sheet based on a detection result provided by the sheet condition detector, wherein the sheet conveying device further includes a print-convey path opposing the image forming device and configured to convey the sheet while the image forming device forms the image on the sheet, a horizontal convey path configured to convey the sheet bearing the image sent from the print-convey path in a horizontal direction, and a reverse-convey path configured to reverse and convey the sheet bearing the image sent from the horizontal convey path, and wherein the upstream conveying roller pair is provided in an exit from the horizontal convey path and the downstream conveying roller pair is provided in the reverse-convey path.

13. The image forming apparatus of claim 12, wherein the print-convey path conveys the sheet with a first force greater than a second force with which the reverse-convey path conveys the sheet, and wherein the horizontal convey path conveys the sheet with a third force smaller than the second force with which the reverse-convey path conveys the sheet.

14. The image forming apparatus of claim 12, wherein the horizontal convey path includes a conveying roller and a spur roller opposing the conveying roller, and the conveying roller and the spur roller are configured to convey the sheet.

15. The image forming apparatus of claim 12, wherein the horizontal convey path and the reverse-convey path convey the sheet at a first speed greater than a second speed at which the print-convey path conveys the sheet.

* * * * *